US009812051B2

(12) United States Patent
Hosaka et al.

(10) Patent No.: US 9,812,051 B2
(45) Date of Patent: Nov. 7, 2017

(54) VIDEO PROCESSING CIRCUIT, PROCESSING METHOD THEREOF, LIQUID CRYSTAL DISPLAY APPARATUS AND ELECTRONICS DEVICE

(71) Applicant: SEIKO EPSON CORPORATION, Tokyo (JP)

(72) Inventors: Hiroyuki Hosaka, Matsumoto (JP); Hidehito Iisaka, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 531 days.

(21) Appl. No.: 14/253,444

(22) Filed: Apr. 15, 2014

(65) Prior Publication Data

US 2014/0225936 A1 Aug. 14, 2014

Related U.S. Application Data

(62) Division of application No. 12/871,314, filed on Aug. 30, 2010, now abandoned.

(30) Foreign Application Priority Data

Sep. 1, 2009 (JP) ..... 2009-201675

(51) Int. Cl.

| | |
|---|---|
| ***G09G 5/10*** | (2006.01) |
| ***G09G 3/20*** | (2006.01) |
| ***G09G 3/36*** | (2006.01) |

(52) U.S. Cl.

CPC ..... *G09G 3/2003* (2013.01); *G09G 3/3648* (2013.01); *G09G 3/2011* (2013.01); *G09G 2320/0209* (2013.01)

(58) Field of Classification Search

CPC ..... G09G 2320/0276; G09G 2360/16; G09G 2320/0626; G09G 3/3648; G09G 3/3611;

(Continued)

(56) References Cited

U.S. PATENT DOCUMENTS

2004/0196237 A1* 10/2004 Pfeiffer ..... G09G 3/2011 345/89
2008/0018630 A1 1/2008 Fujino
2009/0243983 A1* 10/2009 Ohashi ..... G09G 3/2011 345/89

FOREIGN PATENT DOCUMENTS

EP 1 225 558 A1 7/2002
JP A-6-34965 2/1994

(Continued)

OTHER PUBLICATIONS

European Search Report dated Nov. 30, 2010 from European Patent Application No. 10174754.1.

*Primary Examiner* — Nicholas Lee
*Assistant Examiner* — Ngan T Pham Lu
(74) *Attorney, Agent, or Firm* — Oliff PLC

(57) ABSTRACT

A video processing circuit for specifying an applied voltage that is applied to a liquid crystal included in each pixel on the basis of a video signal, the video processing circuit includes a correction unit configured to, if the applied voltage specified by the video signal is a voltage of a level lower than a voltage level that is sufficient to an extent that can provide liquid crystal molecules with initial inclination angles, perform correction so that the applied voltage has a voltage level that is sufficient to an extent that can provide the liquid crystal molecules with initial inclination angles.

16 Claims, 15 Drawing Sheets

(58) Field of Classification Search
CPC ..... G09G 3/2003; G09G 3/2011; G09G 2320/0209
USPC ..... 345/690
See application file for complete search history.

(56) References Cited

FOREIGN PATENT DOCUMENTS

| | | |
|---|---|---|
| JP | A-10-105108 | 4/1998 |
| JP | A-2008-281947 | 11/2008 |
| JP | A-2009-69608 | 4/2009 |
| JP | A-2009-104053 | 5/2009 |

* cited by examiner

SCANNING LINE DRIVING CIRCUIT

VIDEO PROCESSING CIRCUIT

VIDEO SIGNAL (BEFORE CORRECTION)

EDGE DETECTION

CORRECTION PROCESSING (ALL DIRECTIONS, 1 PIXEL)

CORRECTION PROCESSING (ALL DIRECTIONS, 2 PIXELS)

CORRECTION PROCESSING (HORIZONTAL DIRECTION, 1 PIXEL)

CORRECTION PROCESSING (HORIZONTAL DIRECTION, 2 PIXELS)

NO CORRECTION PROCESSING IS PERFORMED

CORRECTION PROCESSING IS PERFORMED (1 PIXEL)

CORRECTION PROCESSING IS PERFORMED (2 PIXELS)

VIDEO PROCESSING CIRCUIT, PROCESSING METHOD THEREOF, LIQUID CRYSTAL DISPLAY APPARATUS AND ELECTRONICS DEVICE

This application is a divisional application of U.S. application Ser. No. 12/871,314 filed on Aug. 30, 2010, which claims priority to JP 2009-201675 filed in Japan on Sep. 1, 2009, the entire disclosures of each of which are hereby incorporated by reference it their entirety.

BACKGROUND

1. Technical Field

The present invention relates to a technology which enables reducing defects occurring when images are displayed on liquid crystal panels.

2. Related Art

Liquid crystal panels are each configured to include liquid crystals interposed between a pair of substrates the distance between which is kept constant.

More specifically, such a liquid crystal panel is configured to include a pair of substrates, one having pixel electrodes for respective pixels therein, which are arrayed in a matrix shape, the other one having a common electrode therein, which is provided so as to be common across the pixels, and liquid crystals interposed between the pixel electrodes and the common electrode. When a voltage of a level in accordance with a gray scale is applied and maintained between each of the pixel electrodes and the common electrode, alignment conditions of the liquid crystals interposed therebetween are determined for each pixel corresponding to the pixel electrode, and thereby, a transmittance ratio or a reflection ratio of each pixel is controlled. Therefore, it can be said that, in such a configuration as described above, among electric fields acting across liquid crystal molecules, only components of the electric fields, which extend in a direction from the pixel electrodes towards the common electrode (or in a direction opposite thereto), that is, in a direction vertical to (in a direction longitudinal to) the surfaces of the substrates, contribute to display controls.

By the way, owing to a recent trend, in which pitches between adjacent pixels have become smaller in response to demands for downsizing liquid crystal panels and increasing high-resolution displaying capability thereof, electric fields are likely to occur between adjacent pixel electrodes, that is, electric fields are likely to occur in a direction parallel to the surfaces of the substrates, and influences thereof have been increased to an unignorable extent. For example, owing to the influences, there has occurred a problem in that, in liquid crystal panels employing a method, such as the twisted nematic (TN) method and the vertical alignment (VA) method, once lateral-direction electric fields are applied to liquid crystal modules, which are to be driven by longitudinal-direction electric fields, areas where alignment failures of liquid crystal molecules occur (the areas are called reverse tilt domains), and thus, lead to defects in displaying of images.

In order to reduce the influences due to the reverse tilt domain, various technologies, such as a first technology, in which the structure of a liquid crystal panel is improved by determining the shape of a light shielding layer (an aperture portion) in accordance with the positions of pixel electrodes (for example, refer to JP-A-6-34965 (FIG. 1)), and a second technology, in which, it is determined that the reverse tilt domains occur in the case where an average luminance value calculated from video signals is smaller than or equal to a threshold value, and video signals each having an output signal value larger than or equal to a preset output signal value are clipped (for example, refer to JP-A-2009-69608 (FIG. 2)), have been proposed.

However, there are disadvantages in that, the above-described first technology, in which the occurrences of the reverse tilt domains are reduced by improving the structure of liquid crystal panels, is likely to decrease an aperture ratio, and further, cannot be applied to liquid crystal panels which have already been manufactured without performing the improvement of the structure thereof. Furthermore, there is a disadvantage in that, in the above-described second technology, in which video signals each having an output signal value larger than or equal to a preset output signal value are clipped, the brightness of displaying images is limited to the preset output signal value.

SUMMARY

Accordingly, an advantage of some aspects of the invention is to provide a technology which enables eliminating the above-described defects, and further, reducing the occurrences of the reverse tilt domains.

A video processing circuit according to a first aspect of the invention is a video processing circuit for specifying an applied voltage that is applied to a liquid crystal included in each pixel on the basis of a video signal, and the video processing circuit includes a correction unit configured to, if the applied voltage specified by the video signal is a voltage of a level lower than a voltage level that is sufficient to an extent that can provide liquid crystal molecules with initial inclination angles, perform correction so that the applied voltage has a voltage level that is sufficient to an extent that can provide the liquid crystal molecules with initial inclination angles.

According to the first aspect of the invention, it is unnecessary to change the structure of the liquid crystal panel 100, and thus, the unnecessity of changing the structure of the liquid crystal panel 100 does not cause reduction of an aperture ratio, and further, enables applying the liquid crystal panel 100 to liquid crystal panels which have already been manufactured without improving the structure thereof. Furthermore, if the applied voltage specified by the video signal is a voltage of a level lower than a voltage level that is sufficient to an extent that can provide liquid crystal molecules with initial inclination angles, a correction is performed so that the applied voltage has a voltage level that is sufficient to an extent that can provide the liquid crystal molecules with initial inclination angles, and thus, other pixels are not affected by this correction, so that the brightness of displaying images is not limited to a preset value.

In the first aspect, preferably, the detection unit is configured to, if a pixel having an applied voltage therefor whose level is around a voltage level corresponding to a maximum gray scale level and a pixel having an applied voltage therefor whose level is around a voltage level corresponding to a minimum gray scale level are located adjacent to each other, and further, if the applied voltage applied to any one of the pixels located adjacent to each other, the applied voltage being specified by the video signal, is a voltage of a level lower than a voltage level that is sufficient to an extent that can provide the liquid crystal molecules with initial inclination angles, perform correction so that the applied voltage has a voltage level that is sufficient to an extent that can provide the liquid crystal molecules with initial inclination angles. In such a manner as described above, with respect to pixels, for which reverse tilt domains are likely to occur, it is possible to cause variations of brightness due to the correction to be unlikely to be perceived.

Further, in the first aspect, preferably, the correction unit is configured to, if the applied voltage applied to a pixel adjacent to the pixel to be corrected, the applied voltage being specified by the video signal, is a voltage of a level lower than a voltage level that is sufficient to an extent that can provide the liquid crystal molecules with initial inclination angles, perform correction so that the applied voltage has a voltage level that is sufficient to an extent that can provide the liquid crystal molecules with initial inclination angles.

Further, a video processing circuit according to a second aspect of the invention is a video processing circuit for specifying an applied voltage that is applied to a liquid crystal element included in each pixel on the basis of a video signal, and the video processing circuit includes an edge detection unit configured to detect an edge between a first pixel that has an applied voltage therefor whose level is lower than a first voltage level, the applied voltage being specified by the video signal, and a second pixel that has an applied voltage therefor whose level is higher than or equal to a second voltage level which is higher than the first voltage level, the applied voltage being specified by the video signal, and a correction unit configured to, if, for the first pixel adjacent to the edge, the applied voltage specified by the video signal is a voltage of a level lower than a third voltage level which is lower than the first voltage level, perform correction so that the level of an applied voltage applied to a liquid crystal element corresponding to the first pixel can be changed from the level of the applied voltage specified by the video signal to a predetermined voltage level. According to the second aspect of the invention, it is unnecessary to change the structure of the liquid crystal panel 100, and thus, the unnecessity of changing the structure of the liquid crystal panel 100 does not cause reduction of an aperture ratio, and further, enables applying the liquid crystal panel 100 to liquid crystal panels which have already been manufactured without improving the structure thereof. Furthermore, if, for the first pixel adjacent to the detected edge, the applied voltage specified by the video signal is a voltage of a level lower than a third voltage level, perform correction so that the level of an applied voltage applied to a liquid crystal element corresponding to the first pixel can be changed to a predetermined voltage level, and thus, other pixels are not influenced by the correction, so that the brightness of displaying images is not limited to a preset value.

In the second aspect, preferably, the correction unit is configured to, if, for one or more pixels that are located adjacent to the first pixel adjacent to the edge, and further, are located at the opposite side of the first pixel from the edge, the level of an applied voltage applied to the one or more pixels is lower than the third voltage level, perform correction so that the applied voltage applied to one or more liquid crystal elements corresponding to the one or more pixels can be changed from the applied voltage specified by the input video signal to the predetermined voltage level. By performing correction so that the applied voltage specified by the video signal can be changed to the predetermined voltage level, a period of time while the level of the applied voltage applied to the liquid crystal elements corresponding to the pixels have been the predetermined voltage level is lengthened, and thus, it is possible to reduce occurrences of reverse tilt domains more certainly. Preferably, the predetermined voltage level is lower than or equal to 1.5 volt. Because, under such a condition, variations of brightness due to the correction are unlikely to be perceived, and further, liquid crystal molecules are unlikely to be affected by lateral-direction electric fields.

In addition, besides a video processing circuit, the invention can be also conceptualized as a video processing method, a liquid crystal display apparatus, and an electronics device including the liquid crystal display apparatus.

BRIEF DESCRIPTION OF THE DRAWINGS

The invention will be described with reference to the accompanying drawings, wherein like numbers reference like elements.

DETAILED DESCRIPTION OF EMBODIMENTS

First Embodiment

Hereinafter, an embodiment according to the invention will be described with reference to drawings.

Figure 1:
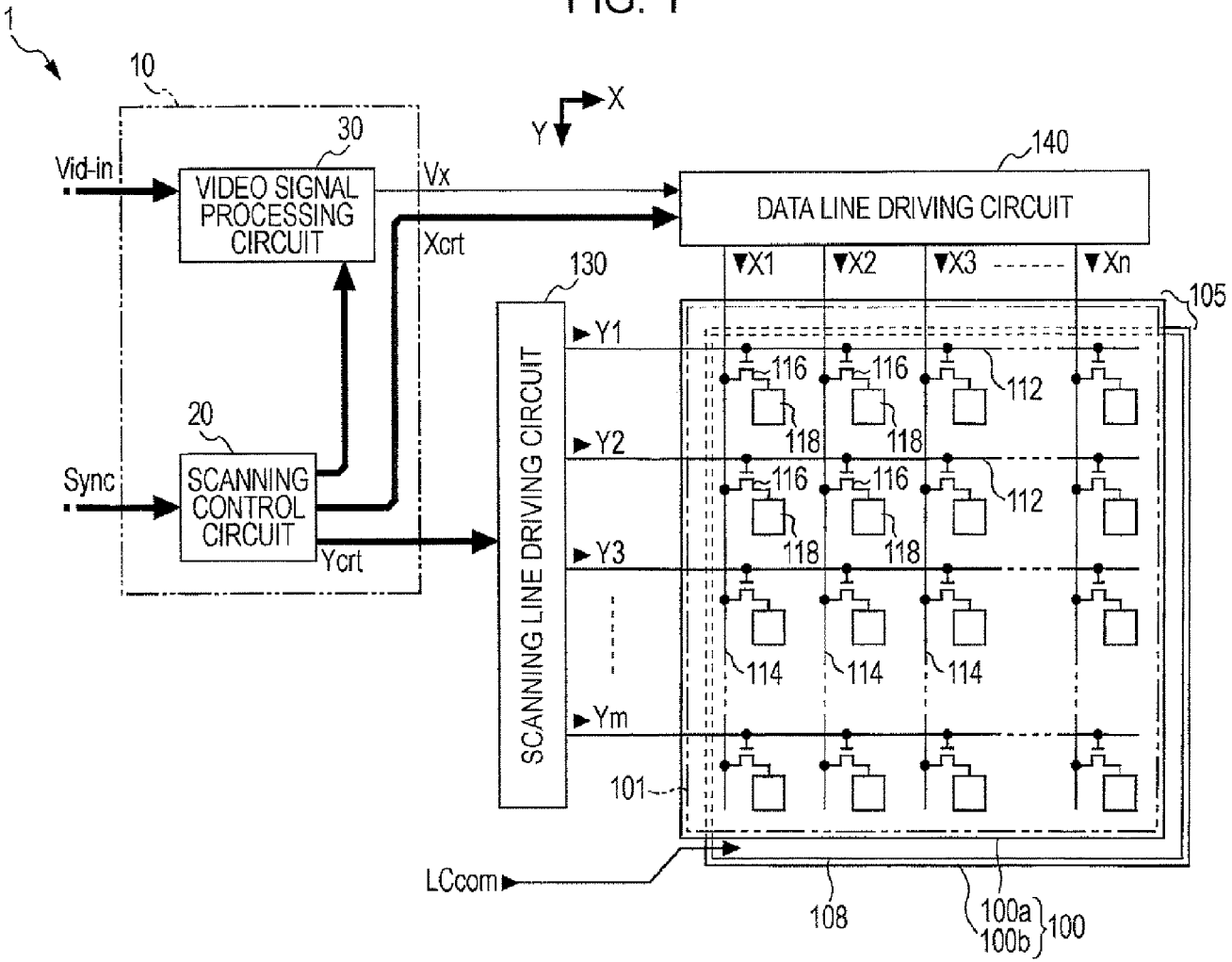
FIG. 1 is a diagram illustrating a liquid crystal apparatus, to which a video processing circuit according to a first embodiment of the invention is applied.

FIG. 1 is a block diagram illustrating an overall configuration of a liquid crystal display apparatus, to which a video processing circuit according to an embodiment of the invention is applied.

As shown in FIG. 1, the liquid crystal display apparatus 1 is configured to include a control circuit 10, a liquid crystal panel 100, a scanning line driving circuit 130, and a data line driving circuit 140.

Among these elements, the control circuit 10 is provided with a video signal Vid-in from an upper apparatus in synchronization with a synchronization signal Sync. The video signal Vid-in is digital data which specifies gray scales for respective pixels included in the liquid crystal panel 100, and is supplied in a scanning order in accordance with a vertical scanning signal, a horizontal scanning signal and a dot clock signal (all of these signals are omitted from illustration in FIG. 1), which are included in the synchronization signal Sync.

In addition, as described above, the video signal Vid-in specifies gray scales, and since the gray scales determine the levels of voltages applied to individual liquid crystal elements, it may be said that the video signal Vid-in specifies the levels of voltages applied to the individual liquid crystal elements.

The control circuit 10 is configured to include a scanning control circuit 20 and a video processing circuit 30, and among these circuits, the scanning control circuit 20 generates various kinds of control signals in synchronization with the synchronization signal Sync and performs control of individual portions by using the generated signals in synchronization with the synchronization signal Sync. The video processing circuit 30, which will be described below in detail, performs processing on the digital video signal Vid-in to output an analog data signal Vx.

The liquid crystal panel 100 is configured to include an element substrate (a first substrate) 100*a* and an opposite substrate (a second substrate) 100*b*, which are bonded to each other so that a constant distance can be kept therebetween, and further, a liquid crystal layer 105 interposed therebetween, which is driven by electric fields extending in a longitudinal direction relative to the substrates.

On one of surfaces of the element substrate 100*a*, the surface being opposite the opposite substrate 100*b*, a plurality lines (m lines) of scanning lines 112 are provided along an X-axis direction (a lateral direction), while a plurality rows (n rows) of data lines 114 are provided along a Y-axis direction (a longitudinal direction), and further, are arrayed so as to mutually maintain an electrical isolation condition between the scanning lines 112 and themselves.

In addition, in this embodiment, in order to easily identify each of the scanning lines 112, the scanning lines 112 are sometimes called in an ascending order from a scanning line which is shown at the most upper portion among the scanning lines shown in FIG. 1, that is, a 1st line, a 2nd line, a 3rd line, . . . , an (m−1)-th line, an m-th line. In the same manner as described above, in order to easily identify each of the data lines 114, the data lines 114 are sometimes called in an ascending order from a data line which is shown at the most left portion among the data lines shown in FIG. 1, that is, a 1st row, a 2nd row, a third row, . . . , an (n−1)-th row, an n-th row.

In the element substrate 100*a*, pairs each consisting of an n-channel type TFT 116 and a pixel electrode 118 having a rectangular shape and transparency are provided at points corresponding to respective interchanges of the scanning lines 112 and the data lines 114. The TFT 116 has a gate electrode connected to one of the scanning lines 112, a source electrode connected to one of the data lines 114, and a drain electrode connected to the pixel electrode 118.

Moreover, on one of surfaces of the opposite substrate 100*b*, the surface being opposite the element substrate 100*a*, the common electrode 108 having transparency is provided so as to cover the entire surface thereof. Further, the common electrode 108 is supplied with a voltage LCcom from a circuit, which is omitted from illustration.

In addition, since the scanning lines 112, the data lines 114, the TFTs 116 and the pixel electrodes 118 are provided on the opposite surface of the element substrate 100*a*, the opposite surface being located at the backside of paper, in FIG. 1, these elements are necessary to be illustrated in slotted lines; however, in general, elements illustrated in slotted lines are difficult to be identified, and thus, these elements are illustrated in full lines.

Figure 2:
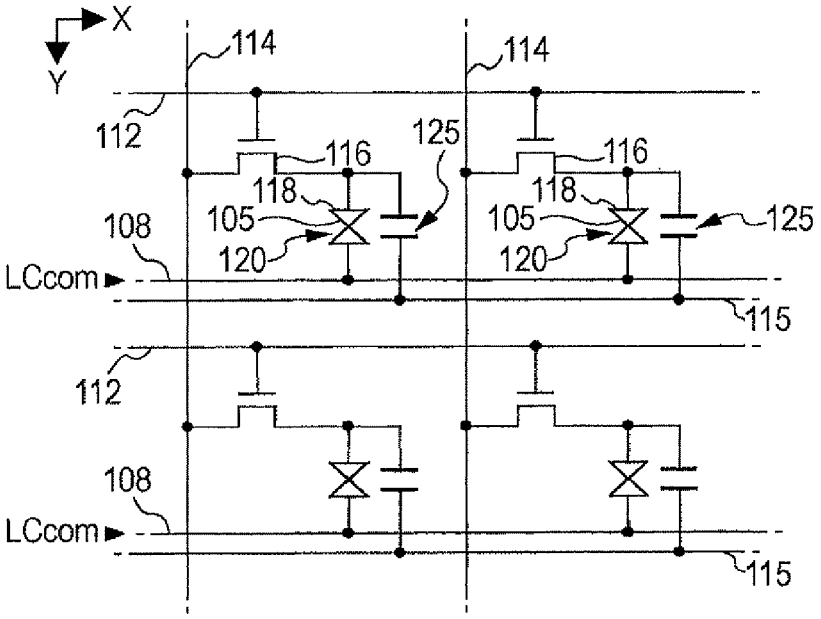
FIG. 2 is a diagram illustrating an equivalent circuit of a liquid crystal element in a liquid crystal apparatus according to a first embodiment of the invention.

An equivalent circuit of the liquid crystal panel 100 is shown in FIG. 2, and is configured to have liquid crystal elements 120 each including liquid crystals 105 interposed between the pixel electrode 118 and the common electrode 108, the liquid crystal elements 120 being arrayed so as to correspond to respective interchanges of the scanning lines 112 and the data lines 114.

Further, in the equivalent circuit of the liquid crystal panel 100, an auxiliary capacitor (a storage capacitor) 125, which is omitted from illustration in FIG. 1, is actually located in parallel with each of the liquid crystal elements 120, such as shown in FIG. 2. The auxiliary capacitor 125 has two terminals, one being connected to the pixel electrode 118, the other one being connected to a capacitor line 115. A voltage applied to the capacitor line 115 is maintained so as to be temporally constant.

Here, once one of the scanning lines 112 is turned to H level, the TFT 116 having the gate electrode connected to the scanning line is turned on, and as a result, the pixel electrode 118 is connected to one of the data lines 114. Therefore, once a data signal having a voltage of a level corresponding to a certain gray scale is supplied during a period of time while the scanning line 112 is kept to H level, the data signal is applied to the pixel electrode 118 via the TFT 116 having been turned on. Subsequently, when the scanning line 112 is turned to L level, the TFT 116 is turned off, but the voltage having been applied to the pixel electrode 118 is maintained by a capacitive element of the liquid crystal element 120 and the auxiliary capacitor 125.

In the liquid crystal element 120, molecule alignment conditions of the liquid crystal 105 vary in accordance with electric fields generated between the pixel electrode 118 and the common electrode 108. Therefore, if the liquid crystal element 120 is a transparent type, the liquid crystal element 120 results in having a transmisstance ratio in accordance with the level of the voltage having been applied to the pixel electrode 118 and being maintained.

In the liquid crystal panel 100, the transmisstance ratio varies according to each of the liquid crystal elements 120, and thus, the liquid crystal element 120 corresponds to each pixel. Further, an area including these pixels arrayed therein is a display region 101. In addition, in this embodiment, it is assumed that the VA method is applied to the liquid crystals 105, and the liquid crystal elements 120 employ a normally black mode, in which the liquid crystal elements 120 are in a black color condition when no voltage is applied thereto.

Figure 5A:
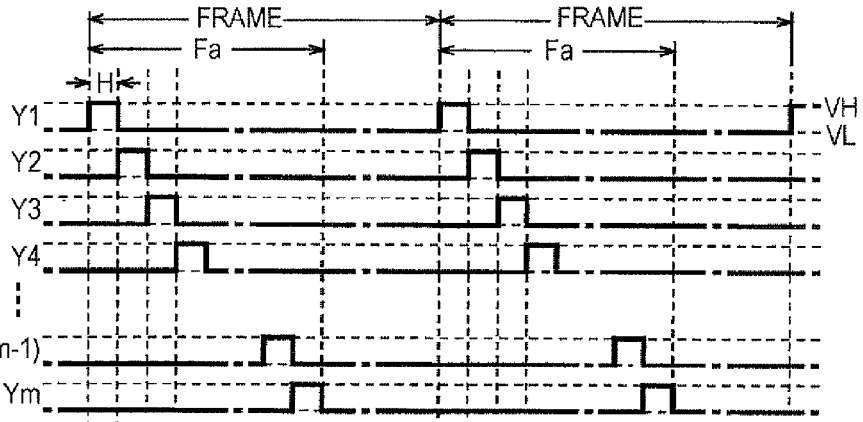
FIGS. 5A and 5B are diagrams each illustrating a display operations of a liquid crystal display apparatus according to a first embodiment of the invention.

The scanning line driving circuit 130 is configured to, in accordance with a control signal Yctr supplied from the scanning control circuit 20, supply the scanning lines 112, i.e., a 1st, a 2nd, a 3rd, . . . , and an m-th scanning lines, with scanning signals Y1, Y2, Y3, . . . , and Ym, respectively. More specifically, as shown in FIG. 5A, within each frame, the scanning line driving circuit 130 sequentially selects the scanning lines 112, that is, in such an order as follows; a 1st, a 2nd, a 3rd, . . . , and an m-th scanning line, and further, causes a scanning signal corresponding to the selected scanning line to be a selection voltage level VH (H-level), and causes scanning signals corresponding to scanning lines other than the selected scanning line to be a non-selection voltage level VL (L-level).

In addition, the above-described frame is a period of time necessary for a frame of images to be displayed by driving the liquid crystal panel 100, and if the frequency of the vertical scanning signal included in the synchronization signal Sync is 60 Hz, the cycle of the frame is 16.7 msec, which is the inverse number of the frequency.

The data line driving circuit 140 performs sampling of the data signals Vx, and supply the sampled signals, i.e., data signals X1 to Xn to the 1st to n-th rows of the data lines 114, respectively, in accordance with a control signal Xctr supplied from the scanning control circuit 20.

In addition, in this explanation, unless particularly specified, with respect to voltages, except a voltage applied to the liquid crystal element 120, a reference level of the voltages, which is equal to a voltage value "zero", is a ground voltage potential, which is omitted from illustration. The voltage applied to the liquid crystal element 120 is a voltage potential difference between the voltage LCcom applied to the common electrode 108 and a voltage applied to the pixel electrode 118, and is to be handled as a voltage that is different from other voltages.

Figure 4A:
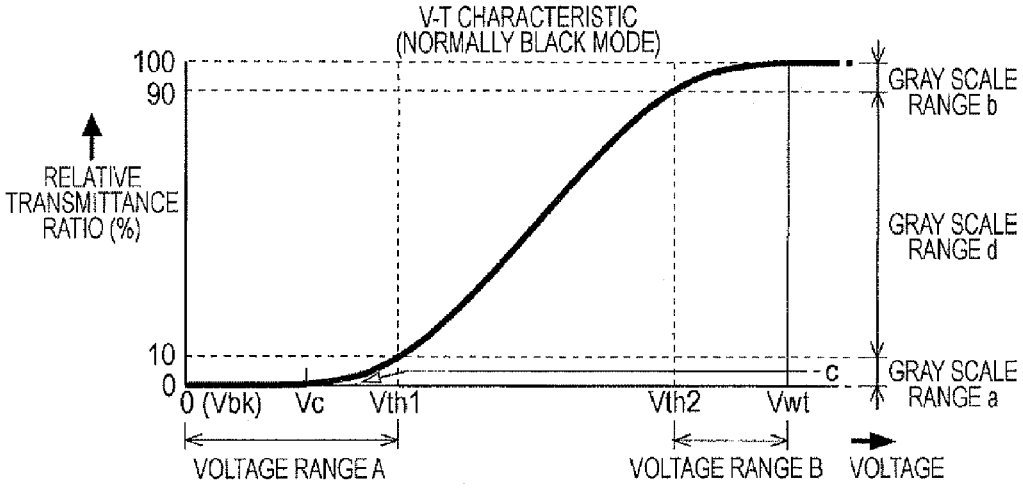
FIGS. 4A and 4B are diagrams each illustrating a display characteristic of a liquid crystal display apparatus according to a first embodiment of the invention.

Further, in this embodiment, in the normally black mode, a relation between an applied voltage and a transmisstance ratio for the liquid crystal element 120 is represented as a V-T characteristic such as shown in FIG. 4A. Therefore, in order to cause the liquid crystal element 120 to have a transmisstance ratio in accordance with a certain gray scale specified by the video signal Vid-in, it is thought that merely applying a voltage of a level in accordance with the gray scale to the liquid crystal element is necessary.

However, merely determining the level of the voltage applied to the liquid crystal element 120 in accordance with the gray scale specified by the video signal Vid-in is likely to cause a defect in displaying of images due to occurrence of reverse tilt domains.

It is considered as one of causes of this defect that, in the liquid crystal element 120, once interposed liquid crystal molecules, which are in an unstable condition, are misaligned by the influence of lateral-direction electric fields, as a result, afterward, the liquid crystal molecules are unlikely to be in a normal alignment condition in accordance with the applied voltage.

When the level of a voltage applied to the liquid crystal element 120 is within a voltage range A larger than or equal to a black level voltage Vbk in the normally black mode but smaller than a threshold value Vth1 (a first voltage), since an amount of a restraining force created by longitudinal-direction electric fields is slightly larger than an amount of a restraining force created by alignment films, the alignment of liquid crystal molecules is likely to be in a misaligned condition. This condition is the above-described condition where the liquid crystal molecules are unstable.

For convenience of explanation, it is assumed that a transmisstance ratio range (a gray scale range) including therein liquid crystal elements each having an applied voltage whose level is within the voltage range A, is denoted by "a".

Further, the above-described influence of lateral-direction electric fields occurs in the case where an amount of a voltage potential difference between pixel electrodes, which are located adjacent to each other, becomes large, and such a phenomenon occurs in the case where, in an image to be displayed, dark pixels and bright pixels are located adjacent to each other, the voltage levels of the dark pixels being equal to the black level voltage Vbk or being nearly equal to the black level voltage Vbk, the voltage levels of the bright pixels being equal to a white level voltage Vwt or being nearly equal to the white level voltage Vwt.

With respect to the dark pixels and the bright pixels, in the normally black mode such as shown in FIG. 4A, the dark pixels are the liquid crystal elements 120 each having an applied voltage whose level is within the voltage range A. It is the bright pixels that provide the dark pixels with lateral-direction electric fields. In order to specify the bright pixels, it is assumed that the bright pixels are the liquid crystal elements 120 each having an applied voltage whose level is within a voltage range B larger than or equal to a threshold value Vth2 (a second voltage) but smaller than or equal to the white level voltage Vwt in the normally black mode. For convenience of explanation, it is assumed that a transmisstance ratio range (a gray scale range) including liquid crystal elements therewithin each having an applied voltage therefor whose level is within the voltage range B, is denoted by "b".

In addition, in the normally black mode, the threshold value Vth1 may be regarded as an optical threshold voltage which makes a relative transmisstance ratio for liquid crystal elements be 10%, and the threshold value Vth2 may be regarded as an optical saturation voltage which makes the relative transmisstance ratio for liquid crystal elements be 90%.

It can be said that, when a first group of liquid crystal elements each having an applied voltage therefor whose level is within the voltage range A, is located adjacent to a second group of liquid crystal elements each having an applied voltage therefor whose level is within the voltage range B, the first group of liquid crystal elements is in the condition in which reverse tilt domains are likely to occur therein owing to influences of lateral-direction electric fields. In this regard, however, it cannot be said that the reverse tilt domains occur with certainty.

In addition, in contrast, even when the second liquid crystal elements each having an applied voltage therefor whose level is within the voltage range B, is located adjacent to the first group of liquid crystal elements each having an applied voltage therefor whose level is within the voltage range A, the influences of longitudinal electric fields on the second group of liquid crystal elements itself are dominant, thus, the second group of liquid crystal elements is in a stable condition, and thus, never causes the reverse tilt domains, differing from the first group of liquid crystal elements.

Figure 15A:
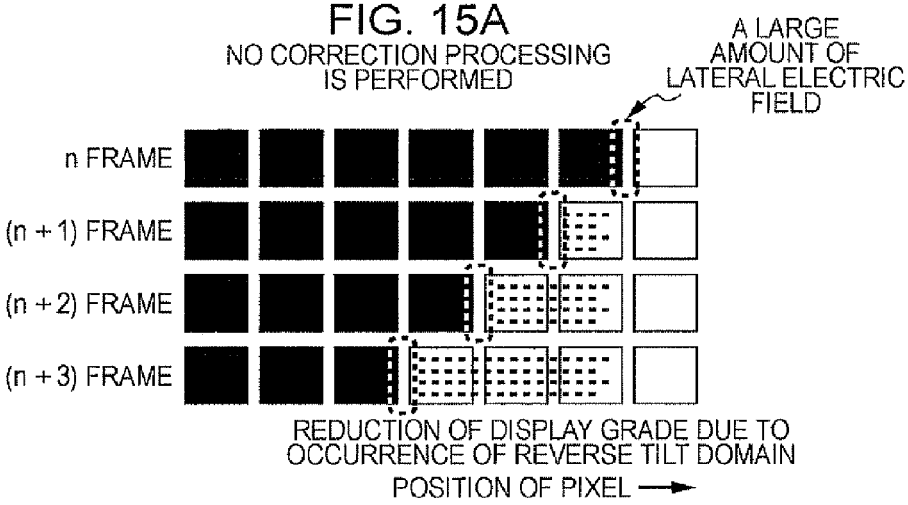
FIGS. 15A, 15B and 15C are diagrams each illustrating a defect and the like in displaying of images due to influences of lateral-direction electric fields.

An example of a defect in displaying of images due to occurrence of reverse tilt domains will be described hereinafter. For example, as shown in FIG. 15A, in the case where, in a certain frame of images, which are specified by the video signal Vid-in, and correspond to individual pixels, on a background consisting of white pixels, a group of black pixels shifts by one pixel every frame, for example, in a left-hand direction, a defect, in which black pixels to be changed to white pixels are not changed to the white pixels owing to occurrence of reverse tilt domains, becomes obvious as a kind of tailing phenomena. In FIG. 15A, for convenience of explanation, from among images included in a certain frame, images, which correspond to video signals included in one of the data lines and are located around a boundary between a group of black pixels and a group of white pixels, are extracted.

It can be considered as one of causes of such a phenomenon that, when a group of white pixels and a group of black pixels are located adjacent to each other, an amount of lateral-direction electric fields between these groups of pixels becomes large, and thereby, within an area covered by the group of black pixels, a portion, which is in the condition where reverse tilt domains are likely to occur therein, is created, and further, the portion in such a condition is expanded so as to form a continuous area in conjunction with shifting of the group of black pixels.

In addition, it is to be noted that, in the case where, on a background consisting of white pixels, a group of black pixels shifts by two or more pixels every frame, such a tailing condition does not become obvious, or can be scarcely seen. A reason for this phenomenon can be considered as follows. In a certain frame of images, when a group of white pixels and a group of black pixels are located adjacent to each other, a portion under a condition, in which reverse tilt domains are likely to occur, is created in an area covered by the group of black pixels; however, the portion under such a condition does not form a continuous area but forms discontinuous areas, because the group of black pixels sifts by two or more pixels every frame.

In order to prevent occurrence of defects in displaying of images due to such a occurrence of reverse tilt domains, firstly, even when, in images specified by the video signal Vid-in, a group of dark pixels and a group of bright pixels are located adjacent to each other, in the liquid crystal panel 100, it is important to cause the group of dark pixels and the group of bright pixels not to be located adjacent to each other.

In order to cause the group of dark pixels and the group of bright pixels not to be located adjacent to each other in the liquid crystal panel 100, in the normally black mode, it is necessary merely to increase the levels of voltages applied to liquid crystal elements corresponding to dark pixels located adjacent to bright pixels; however, this method means increasing of the brightness of black level of the dark pixels located adjacent to the bright pixels, regardless of gray scales determined by the video signal Vid-in. For this reason, secondly, it is important to correct the levels of voltages applied to liquid crystal elements corresponding to dark pixels located adjacent to bright pixels so that the variations of black levels of the dark pixels cannot be perceived as much as possible.

Furthermore, however, it cannot be said that the reverse tilt domains occur certainly even when liquid crystal elements (dark pixels) each having an applied voltage therefor whose level is within the voltage range A are located adjacent to liquid crystal elements (bright pixels) each having an applied voltage therefor whose level is within the voltage range B.

Therefore, in this embodiment, in order to prevent occurrence of defects in displaying of images due to occurrence of reverse tilt domains, the liquid crystal display panel 100 is configured so that, firstly, taking into account a fact that, in the case where, in a certain frame of images specified by the video signal Vid-in, a group of dark images and a group of bright images are located adjacent to each other, reverse tilt domains are likely to occur, dark pixels adjacent to white pixels are selected as candidates for correction, and secondly, in the case where, for the dark pixels having been selected as candidates for correction, gray scales of liquid crystal elements corresponding to the selected dark pixels correspond to respective levels of voltages, which are lower than the level of an applied voltage Vc, voltages each having a level equal to the level of the applied voltage Vc are forcibly applied to the liquid crystal elements corresponding to the selected dark pixels, that is, as will be described below in detail, the gray scales of the dark pixels are corrected (replaced) so that they can be equal to a gray scale "c" corresponding to the level of the applied voltage Vc.

Here, liquid crystal molecules in the VA method are configured to, when the levels of voltages applied to liquid crystal elements are equal to zero, be aligned in a direction vertical to the surfaces of the substrates. Further, the applied voltage Vc, the level of which is lower than the threshold value Vth1, is a voltage of a certain level that can provide the liquid crystal molecules with initial inclination angles, and allows the variation of a transmisstance ratio to be hardly perceived relative to a variation of the level of a voltage around the applied voltage Vc. In addition, from a viewpoint of a voltage of a certain level that allows variations of a transmisstance ratio to be hardly perceived around the black level voltage Vbk in the normally black mode, the level of the applied voltage Vc is within a range from 0 to 1.5 volt, and from a viewpoint of a voltage of a certain level that allows liquid crystal molecules to start inclining, the level of the voltage Vc is equal to 1.5 volt. Therefore, it is desirable to make the level of the applied voltage Vc be lower than or equal to 1.5 volt.

In this embodiment, it is the video processing circuit 30, such as shown in FIG. 1, that is configured to, in a frame of images specified by the video signal Vid-in, detect conditions in which dark pixels and bright pixels are located adjacent to each other, and further, when the levels of voltages applied to liquid crystal elements included in the dark pixels are lower than the level of the applied voltage Vc, perform correction so that gray scales of the dark pixels can be equal to the gray scale "c".

Therefore, as a next step, details of the video processing circuit 30 will be described below with reference to FIG. 3.

Figure 3:
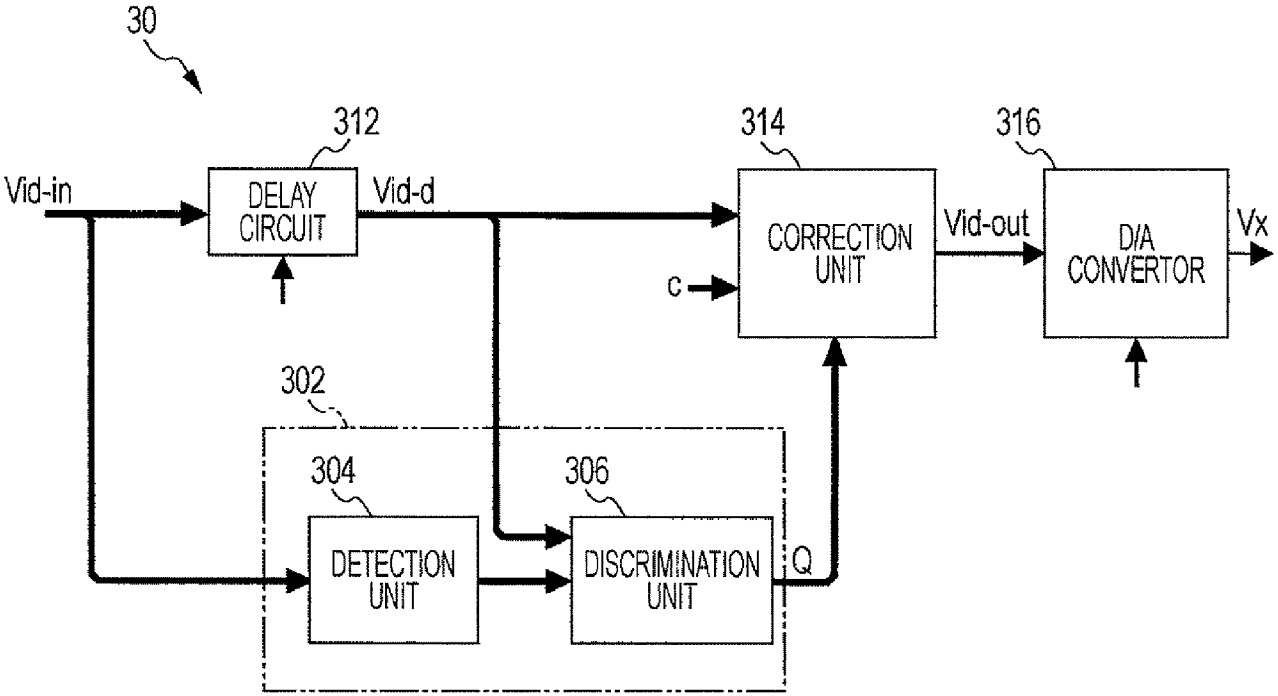
FIG. 3 is a diagram illustrating a configuration of a video processing circuit according to a first embodiment of the invention.

As shown in FIG. 3, the video processing circuit 30 is configured to include an edge detection unit 302, a delay circuit 312, a correction unit 314 and a D/A convertor 316.

Among these elements, the delay circuit 312 stores the video signal Vid-in supplied from an upper apparatus, reads it out after a predetermined elapsed time to output it as a video signal Vid-d, and is configured by using a FIFO (a first in, first out) memory, a multi-stage latch circuit or the like. In addition, the storage and read-out processes performed by the delay circuit 312 are controlled by the scanning control circuit 20.

In this embodiment, the edge detection unit 302 is configured to include a detection unit 304 and a discrimination unit 306. Among these elements, the detection unit 304 is configured to, firstly, analyze a frame of images specified by the video signal Vid-in, determine whether there exist any portions at which pixels whose gray scales are within the gray scale range "a" and pixels whose gray scales are within the gray scale range "b" are located adjacent to each other in a vertical direction and in a horizontal directions relative to the surfaces of the substrates, or not, and secondly, if it is determined that there exist any portions at which pixels whose gray scales are within the gray scale "a" and pixels whose gray scales are within the gray scale "b" are located adjacent to each other, detect edges, which are the portions in which the above-described two kinds of pixels are located adjacent to each other.

In addition, the edges described herein exactly denote portions at which dark pixels whose gray scales are within the gray scale range "a" and bright pixels whose gray scales are within the gray scale range "b" are located adjacent to each other. Therefore, for example, portions at which pixels whose gray scales are within the gray scale range "a" and pixels whose gray scales are within a gray scale range "d", which is different from the gray scale range "a" or the gray scale range "b", are located adjacent to each other, as well as portions at which pixels whose gray scales are within the gray scale range "b" and pixels whose gray scales are within the gray scale "d" are located adjacent to each other, are not handled as the edges.

The discrimination unit 306 discriminates whether pixels specified by the video signal Vid-d having been outputted with a certain amount of delay are the dark pixels contacted with edges having been detected by the detection unit 304, or not, and if the determination result is "Yes", a flag Q for each of outputted signals corresponding to the dark pixels is set to, for example, "1", and if the determination result is "No", the flag Q for each of outputted signals corresponding to pixels having been discriminated as pixels that are not the dark pixels is set to "0".

In addition, the detection unit 304 cannot detect the edges for images to be displayed across the vertical and horizontal directions during a period of time until an amount of stored video signals has reached a certain amount.

For this reason, in order to adjust supply timings of the video signal Vid-in from an upper apparatus, the delay circuit 312 is provided.

The timings of the video signal Vid-in supplied from an upper apparatus are different from those of the video signal Vid-d supplied from the delay circuit 312, and therefore, strictly speaking, horizontal scanning period of times and the like for the video signal Vid-in and the video signal Vid-d do not correspond, but, hereinafter, explanation will be made without making any particular distinctions.

Further, the storage of the video signal Vid-in, which is necessary for the detection unit 304 to detect edges, is controlled by the scanning control circuit 20.

The correction unit 314 is a unit that is configured so that, if the flags Q for any portions of the video signal, which are supplied from the discrimination unit 306, are "1", and further, each of gray scales specified by the corresponding portions of the video signal Vid-d specifies a level darker than the gray scale level "c", each of the portions of the video signal Vid-d is replaced by a video signal having the gray scale level "c", and then, video signals resulting from performing the replacements are outputted as video signals Vid-out.

In addition, the correction unit 314 is configured so that, even if the flag Q for any portions of the video signal, which are supplied from the discrimination unit 306 are "1", and further, each of gray scales specified by the corresponding portions of the video signal Vid-d specifies a level brighter than or equal to the gray scale level "c", and if the flags Q for any portions of the video signal, which are supplied from the discrimination unit 306, are "0", video signals, for which no correction has been made on the gray scales specified by the corresponding portions of the video signal Vid-d, are outputted as the video signals Vid-out.

The D/A converter 316 converts the video signal Vid-out, which include pieces of digital data therein, into the analog data signal Vx.

In order to prevent direct electric currents from being applied to the liquid crystal molecules 105, the voltage of the data signal Vx is alternatively switched to a positive polarity voltage swinging at a higher voltage side and a negative polarity voltage swinging at a lower voltage side relative to a center voltage Vcnt of the amplitude of the video signal at intervals of, for example, one frame.

In addition, the voltage LCcom applied to the common electrode 108 may be regarded as a voltage approximately equal to the voltage Vcnt, but is sometimes adjusted so as to be lower than the voltage Vcnt, taking into consideration off-leakage currents of the n-channel type TFT 116 and the like.

According to this video processing circuit 30, if pixels specified by any video signals of the video signal Vid-d are dark pixels contacted with edges, and further, the gray scales of the pixels specify levels darker than the gray scale level "c", according to this embodiment, the flags Q for the video signals are set to "1", thus, the gray scales of the pixels specified by the video signals of the video signal Vid-d are replaced by the gray scale "c", and video signals resulting from performing the replacements are outputted as the video signals Vid-out.

In contrast, if pixels specified by any video signals of the video signal Vid-d are not dark pixels contacted with edges, or even if pixels specified by any video signals of the video signal Vid-d are dark pixels contacted with edges are contacted with edges, further, if the gray scales of the pixels specify levels brighter than or equal to the gray scale level "c", according to this embodiment, the flags Q for the video signals are set to "0", thus, the gray scales of the pixels specified by the video signals of the video signal Vid-d are not corrected, and the video signals of the video signal Vid-d are outputted as the video signals Vid-out.

Display operations of the liquid crystal apparatus 1 will be hereinafter described. The video signal Vid-in, which is sequentially supplied from an upper apparatus, specifies pixels included in each frame in such an order as follows; from a pixel located at a first line and a first row to a pixel located at a first line and an n-th row, from a pixel located at a second line and a first row to a pixel located at a second line and an n-th row, from a pixel located at a third line and a first row to a pixel located at a third line and an n-th row, . . . , and from a pixel located at an m-th line and a first row to a pixel located at an m-th line and an n-th row. The video processing circuit 30 performs processing for delaying, replacing and the like on the video signal Vid-in, and outputs the resultant signal as the video signal Vid-out.

Here, when viewing a horizontal effective scanning period (Ha) during which the video signal Vid-out including individual video signals corresponding to respective pixels from a pixel located at a first line and a first row to a pixel located at a first line and an n-th row is sequentially outputted, it can be understood that a processed video signal is converted into a positive polar data signal Vx or a negative polar data signal Vx by the D/A convertor 316, such as shown in FIG. 5, and in this case, for example, a processed video signal is converted into a positive polar data signal Vx. The data line driving circuit 140 performs sampling of this data signal Vx, and supply the sampled data signals X1 to Xn to the corresponding 1st row data line to the n-th row data line of the data lines 114.

Further, during a horizontal scanning period of time while the video signal Vid-out including video signals corresponding to respective pixels from a pixel located at the first line and the first row to a pixel located from the first line and the n-th row is sequentially outputted, the scanning control circuit 20 performs control so as to cause the scanning line driving circuit 130 to make only the voltage level of a scanning signal Y1 be H level. Once the scanning signal Y1 is turned to H level, the TFTs 16 that are aligned at the first line are turned on, the sampled data signals X1 to Xn, having been supplied to the 1st row data line to the n-th row data line of the data lines 114, are applied to the pixel electrodes 118 via the TFTs 116 each being in a turned-on condition. By performing such operations as described above, positive polarity voltages in accordance with gray scales, which are specified by respective video signals of the video signal Vid-out, are written into the corresponding pixels from the pixel located at the first line and the first row to the pixel located at the first line and the n-th row.

Subsequently, in the same manner as or a manner similar to that described above, the video signal Vid-out including individual signals corresponding to respective pixels from a pixel located at the second line and the first row to a pixel located at the second line and the n-th row are processed by the video processing circuit 30, and then, is outputted as the video signal Vid-out. Further, after the video signal Vid-out is converted into a positive polarity data signal by the D/A convertor 316, the resultant signal is sampled, and then, the resultant sampled signals are supplied to the first row data line to the n-row row data line 114, respectively, by the data line driving circuits 140.

During a horizontal scanning period of time while the video signal Vid-out including video signals corresponding to respective pixels from a pixel located at the second line and the first row to a pixel located at the second line and the n-th row is sequentially outputted, only the voltage level of a scanning signal Y2 is turned to H level by the scanning line driving circuit 130, thus, the sampled data signals having been supplied to the data lines 114 are applied to the pixel electrodes 118 via the TFTs 116 being located at the second line and being in a turned-on condition. By performing such operations as described above, positive polarity voltages in accordance with gray scales that are specified by the video signals of the data signal Vid-out are written into the corresponding pixels from the pixel located at the second line and the first row to the pixel located at the second line and the n-th row.

Subsequently, the same writing processes as or writing processes similar to those described above are performed on the third line, the fourth line, . . . , and the m-th line, and thereby, voltages in accordance with the corresponding gray scales specified by the video signal Vid-out are written into the corresponding individual pixel elements, and as a result, a transmitted image specified by the video signal Vid-in is created.

In a subsequent frame, the same writing processes as or processes similar to those described above are performed, except for processes in which the video signal Vid-out is converted into a negative polarity data signal by inverting the polarity of data signals.

Figure 5B:
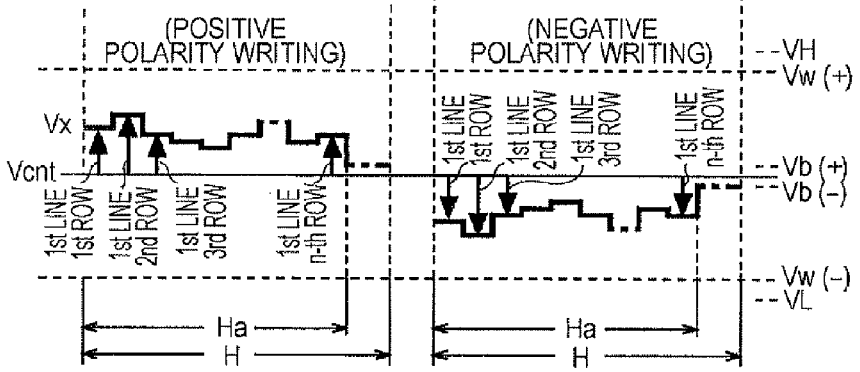

FIG. 5B is a diagram illustrating an example of a voltage waveform of the data signal Vx during a horizontal scanning period of time while the video signal Vid-out including video signals corresponding to respective pixels from a pixel located at a first line and a first row to a pixel located at a first line and an n-th row is outputted from the video processing circuit 30. In this embodiment, which employs the normally black mode, the data signal Vx is configured to, in a positive polarity mode, include voltages, each having a voltage level in accordance with the level of a gray scale having been processed by the video processing circuit 30, and swinging at a higher voltage side (denoted by ↑ in FIG. 5B) relative to the reference center voltage Vcnt, while, in a negative polarity mode, include voltages, each having a voltage level in accordance with the level of a gray scale, and swinging at a lower voltage side (denoted by ↓ in FIG. 5B) relative to the reference center voltage Vcnt.

More specifically, the voltages of the data signal Vx are voltages deviating from the reference center voltage Vcnt by an amount equivalent to an specified gray scale level within a range from a voltage Vw(+) corresponding to a white color to a voltage Vb(+) corresponding to a black color in the case of a positive polarity mode or within a range from a voltage Vw(−) corresponding to a white color to a voltage Vb(−) corresponding to a black color in the case of a negative polarity mode.

The voltage Vw(+) and the voltage Vw(−) have a mutual relationship in which they are located symmetrically relative to the reference center voltage Vcnt. The voltage Vb(+) and the voltage Vb(−) have also a mutual relationship in which they are located symmetrically relative to the reference center voltage Vcnt.

In addition, a diagram of FIG. 5B illustrates the voltage waveforms of the data signal Vx, differing from voltages applied to the liquid crystal elements 120 (i.e., electric potential differences between the pixel electrodes 118 and the common electrode 108). Further, the vertical voltage scale with respective to voltage waveforms of the data signals Vx shown in FIG. 5B is expanded compared with the vertical voltage scale with respect to voltage waveforms of scanning signals and the like shown in FIG. 5A.

A specific example of processing performed by the video processing circuit 30 according to a first embodiment of the invention will be hereinafter described.

Figure 6A:
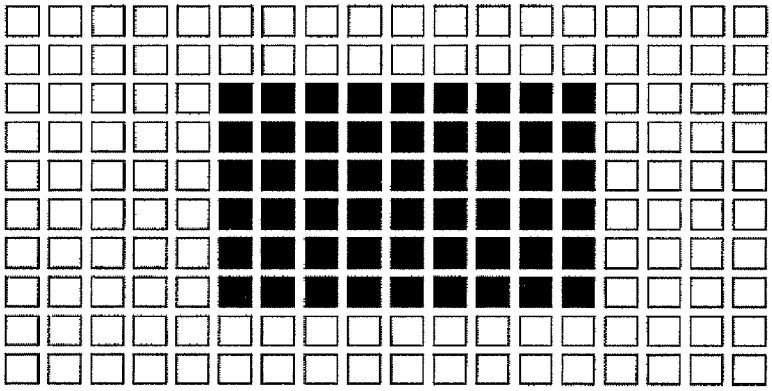
FIGS. 6A, 6B and 6C are diagrams each illustrating correction processing performed by a video processing circuit according to a first embodiment of the invention.
Figure 6B:
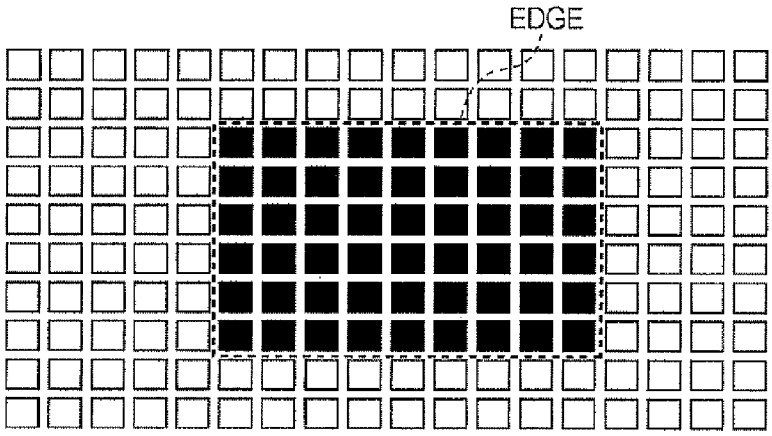

In the case where, for example, as shown in FIG. 6A, a frame of images (or a portion of a frame of images) specified by the video signal Vid-in is an image having a window-shaped area including black pixels therein on a background including white pixels therein, detected edges are such as shown in FIG. 6B.

Figure 6C:
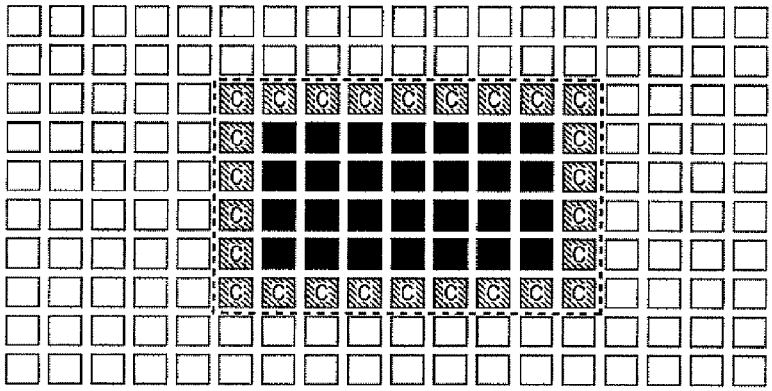

In the case where black pixels contacted with detected edges are provided with gray scale levels darker than the gray scale level "c", video signals specifying the gray scale levels darker than the gray scale level "c" are replaced by video signals specifying the gray scale level "c". Therefore, the image shown in FIG. 6A is corrected to an image shown in FIG. 6C by the video processing circuit 30.

Figure 15B:
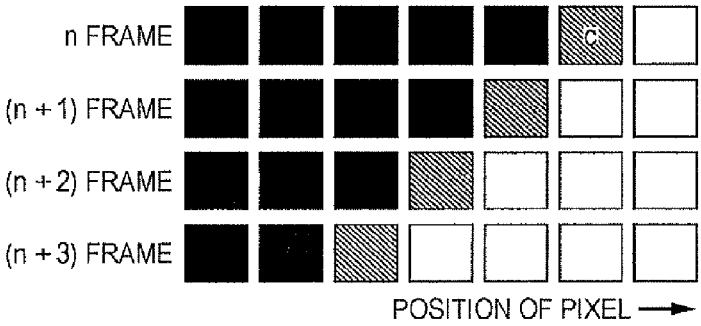

Thus, even when the window-shaped area including black pixels therein shifts in any directions by one pixel, as a result, there is no portion where black pixels adjacent to white pixels are directly changed into white pixels. For example, as shown in FIG. 15B, even when a window-shaped area including black pixels therein shifts in a left-hand direction by one pixel, a black pixel adjacent to a white pixel in the video signal Vid-in is changed into a pixel once, for which a gray scale level is equal to the gray scale level "c" (i.e., the applied voltage Vc), and then, is changed into a white pixel.

Therefore, it is possible to prevent areas where reverse tilt domains are likely to occur to be continuous along with shifting of black pixels. Furthermore, gray scale levels of black pixels, which are contacted with edges among pixels included in a frame of images specified by the video signal Vid-in, are partially replaced, and thus, corrections on displaying images resulting from the replacements are unlikely to be perceived by users. In addition thereto, in this embodiment, unnecessity of changing the structure of the liquid crystal panel 100 does not cause reduction of an aperture ratio, and further, enables applying the liquid crystal panel 100 to liquid crystal panels which have already been manufactured without improving the structure thereof.

Example of Application/Modification of First Embodiment

Various applications/modifications of the above-described first embodiment can be achieved.

First Example

In the first embodiment, in the case where, in a certain image specified by the video signal Vid-in, a group of dark pixels and a group of bright pixel are located adjacent to each other, for one group selected from the two groups of pixels (which is the group of dark pixel in the case of the normally black mode), which has an applied voltage therefor whose level is lower than the level of the applied voltage Vc, video signals that specify the pixels included in the selected group are replaced by different video signals which provide applied voltages for the pixels included in the selected group with the level of the applied voltage Vc so that the gray scale levels of the pixels included in the selected group are made be equal to the gray scale level "c", but the number of groups of pixels, for each of which such the replacement is made, may be two or more.

Figure 7A:
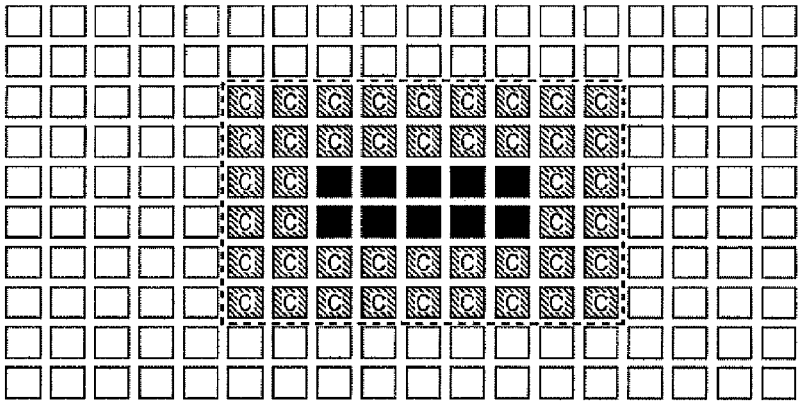
FIGS. 7A, 7B and 7C are diagrams each illustrating different correction processing performed by a video processing circuit according to a first embodiment of the invention.
Figure 7B:
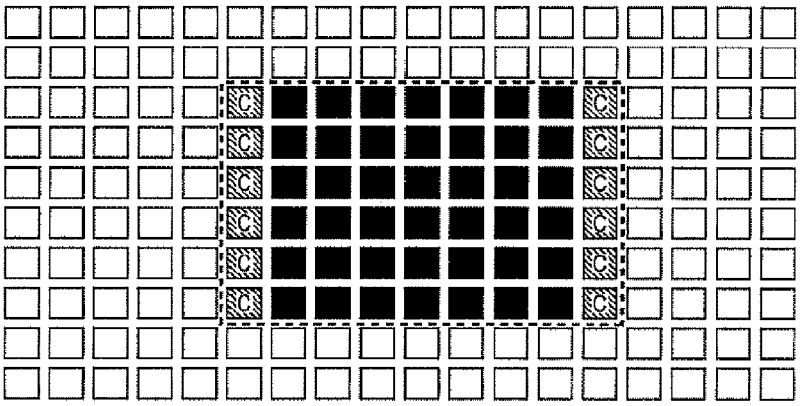

For example, in the case where, for example, a certain image specified by the video signal Vid-in is such as shown in FIG. 6A, detected edges are such as shown in FIG. 6B, and further, the gray scale level of a first group of dark pixels contacted with the edges, as well as the gray scale level of a second group of dark pixels that are located adjacent to dark pixels included in the first group, and further, are located at the opposite side of the first group of dark pixels from the edges, are provided with a gray scale level darker than the gray scale level "c", video signals corresponding to the dark pixels included in the first and second groups may be replaced by video signals specifying the gray scale level "c", such as shown in FIG. 7A.

In the case where the gray scale levels of the two groups of pixels are configured to be replaced in such a manner as described above, when the window-shaped area including black pixels therein shifts in any directions by one pixel for each frame, a period of time while the gray scale levels of black pixels adjacent to white pixels are equal to the gray scale level "c" is equivalent to a duration time of two frames.

Figure 15C:
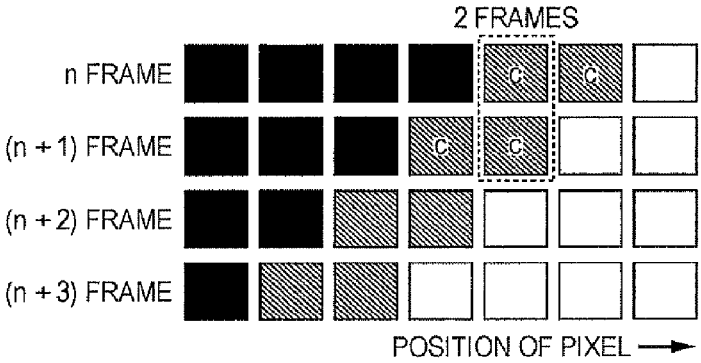

For example, as shown in FIG. 15C, when a window-shaped area including black pixels therein shifts in a left-hand direction by one pixel for each frame, the status of each of black pixels adjacent to white pixels in the video signal Vid-in is transited by one frame in the following order; (a black level)→gray scale level "c"→gray scale level "c" →white level. Therefore, a period of time while liquid crystal molecules are supplied with initial inclination angles is equal to a during time of two frames, which is twice that of the first embodiment, and thus, it is possible to increase effects on suppression of occurrence of reverse tilt domains.

Further, the number of pixel candidates to be replaced is not limited to "2", but may be "3" or more. For example, as will be hereinafter described in a second embodiment, the number of pixel candidates to be replaced may be "six".

Second Example

In the first embodiment, portions at which dark pixels and bright pixels are located adjacent to each other in a vertical direction and in a horizontal direction are detected as edges, and a reason why the detection is performed for the vertical direction and the horizontal direction is that handling can be performed even when areas each including black pixels therein shift in any directions.

However, for example, taking into consideration shifting of a cursor and the like, as shifting directions of black (dark) pixels, sometimes, it is sufficient to suppose only a horizontal (an X-axis) direction. Particularly, since video signals included in the video signal Vid-in, which correspond to individual pixels, are sequentially supplied in an order from a pixel located at a 1st line and a 1st row to a pixel located at a 1st line and an n-th row, from a pixel located at a 2nd line and a 1st row to a pixel located at a 2nd line and an n-th row, from a pixel located at a 3rd line and a 1st row to a pixel located at a 3rd line and an n-th row, . . . , and from a pixel located at an m-th line and 1st row to a pixel located at an m-th line and an n-th row, supposing only the horizontal direction as the shifting direction admits of simplifying the configuration of the edge detection unit 302, as will be described below in a second embodiment.

In addition, in the case where only a horizontal direction is supposed as a shifting direction of dark pixels, besides a method which will be described in a second embodiment, another method, in which vertical-direction components of detected edges are noticed, and dark pixels contacted with the vertical-direction components of the detected edges (and further, dark pixels adjacent to the above-described dark pixels) are handled as candidates for correction, may be adopted.

Figure 7C:
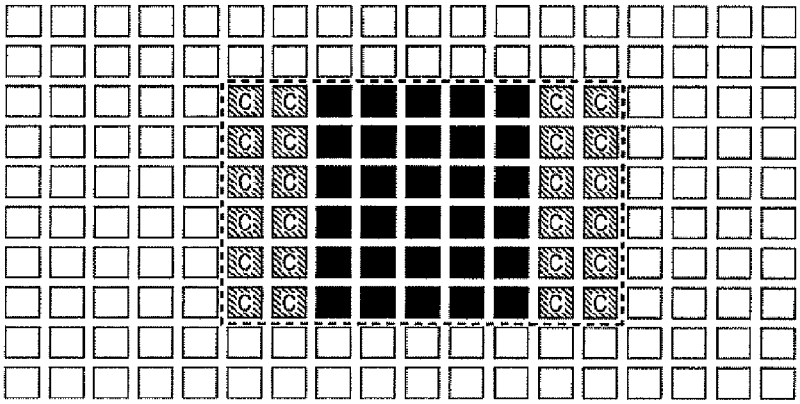

For example, in the case where a frame image specified by the video signal Vid-in is such as shown in FIG. 6A, and detected edges are such as shown in FIG. 6B, when dark pixels contacted with vertical-direction edges by video signals are provided with gray scale levels darker than the gray scale level "c", respectively, these video signals may be replaced by video signals which provide the dark pixels contacted with vertical-direction edges with the gray scale level "c" (refer to FIG. 7C). Further, in the case where first dark pixels contacted with vertical-direction edges and second dark pixels adjacent to the first dark pixels by video signals are provided with gray scale levels darker than the gray scale level "c", theses current video signals may be replaced by video signals which specify the gray scale level "c" (refer to FIG. 7C).

Second Embodiment

Next, a video processing circuit according to a second embodiment will be described below. In this second embodiment, in the normally black mode, edges in a horizontal direction, that is, portions at which a group of dark pixels and a group of bright pixels are located adjacent to each other in a horizontal direction, are detected, and a dark pixel contacted with the edge and five dark pixels which are continuously aligned at the opposite side of the dark pixel from the edge, that is, a total of six dark pixels, are handled as candidates for correction.

Figure 8:
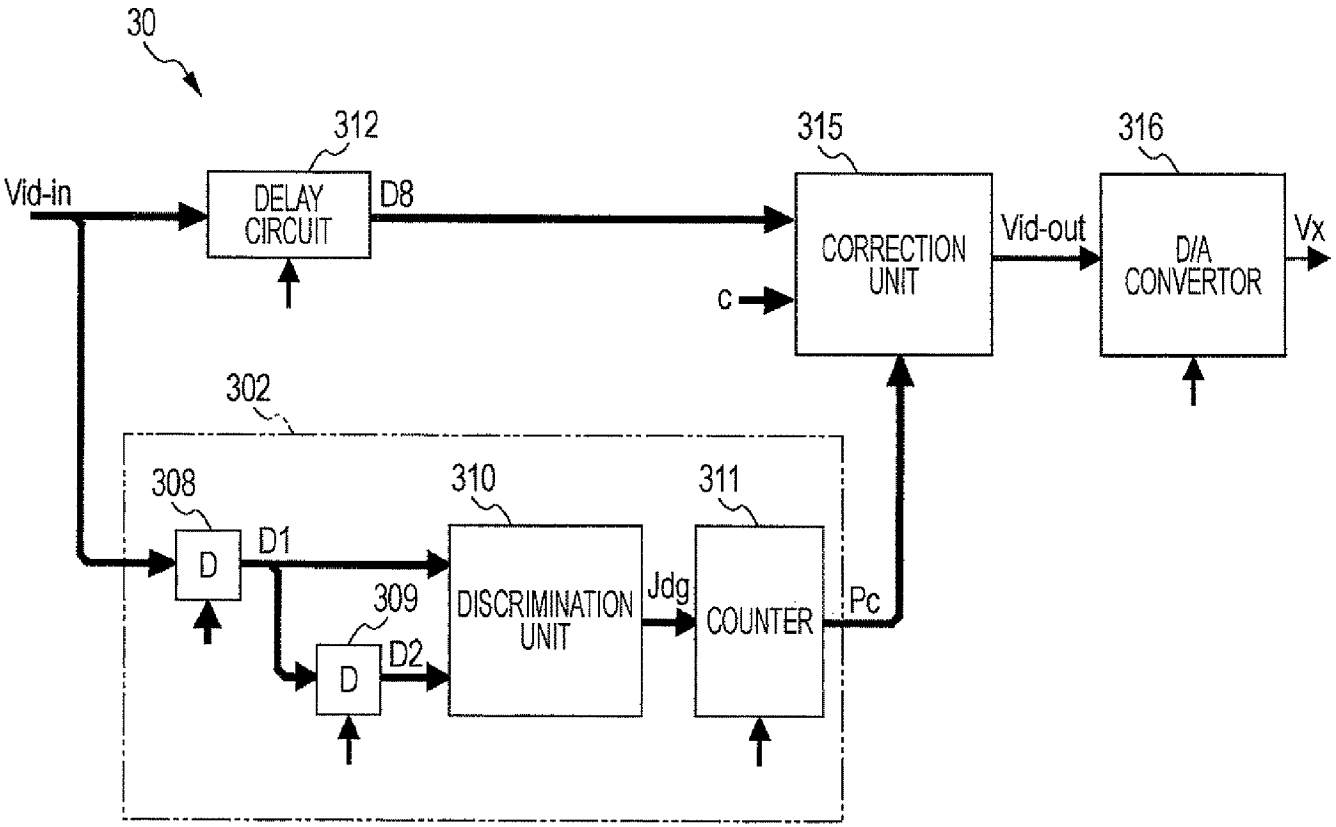
FIG. 8 is a diagram illustrating a configuration of a video processing circuit according to a second embodiment of the invention.

FIG. 8 is a block diagram illustrating a configuration of the video processing circuit 30 according to the second embodiment, and the configuration of the edge detection unit 302 is changed so as to be specific to detection of edges.

In FIG. 8, a delay circuit (D) 308 is configured to output a video signal D1, which is caused to be delayed by one cycle of a dot clock signal C1k, that is, by one pixel. A delay circuit (D) 309 is configured to output a video signal D2, which is caused to be delayed by one cycle of the dot clock signal C1k. Therefore, as a result, the video signal D1 has a relation with the video signal D2, in which the video signal D1 temporally precedes the video signal D2 by one pixel.

In addition, in this example, the delay circuit 312 is configured to output a video signal D8 resulting from causing the video signal Vid-in to be delayed by eight cycles of the dot clock signal C1k, that is, by eight pixels.

A discrimination unit 310 is configured to compare the gray scale specified by the video signal D1 and the gray scale specified by the video signal D2, and (1) in a first case where the gray scale specified by the video signal D1 is within a gray scale range "a", and further, the gray scale specified by the video signal D2 is within a gray scale range "b", or conversely, (2) in a second case where the gray scale specified by the video signal D1 is within a gray scale range "b", and further, the gray scale specified by the video signal D2 is within a gray scale range "a", discriminate that, in each of the first case and the second case, an edge has been detected, and output a discrimination signal Jdg of H level.

In addition, upon discrimination of the second case, the discrimination unit 310 turns the discrimination signal Jdg to H level simultaneously with the discriminated timing, but upon discrimination of the first case, the discrimination unit 310 turns the discrimination signal Jdg to H level at a timing when the discriminated timing is delayed by six cycles of the dot clock signal C1k (the number "six" denoting the number of candidate pixels to be corrected)

A counter 311 is configured to reset a count value Pc to "0" when the discrimination signal Jdg falls from H level to L level, and subsequently, allow the count value Pc to be incremented by the dot clock C1k.

The correction unit 315 is configured to, in the case where the count value Pc is a valid value, and further, the gray scale specified by a video signal D8 is lower than the gray scale "c", replace the video signal D8 by a video signal specifying the gray scale "c". In addition, in this example, the correction unit 315 regards values from "0" to "5" as valid values of the count value Pc.

Figures 9A, 9B, 9C:
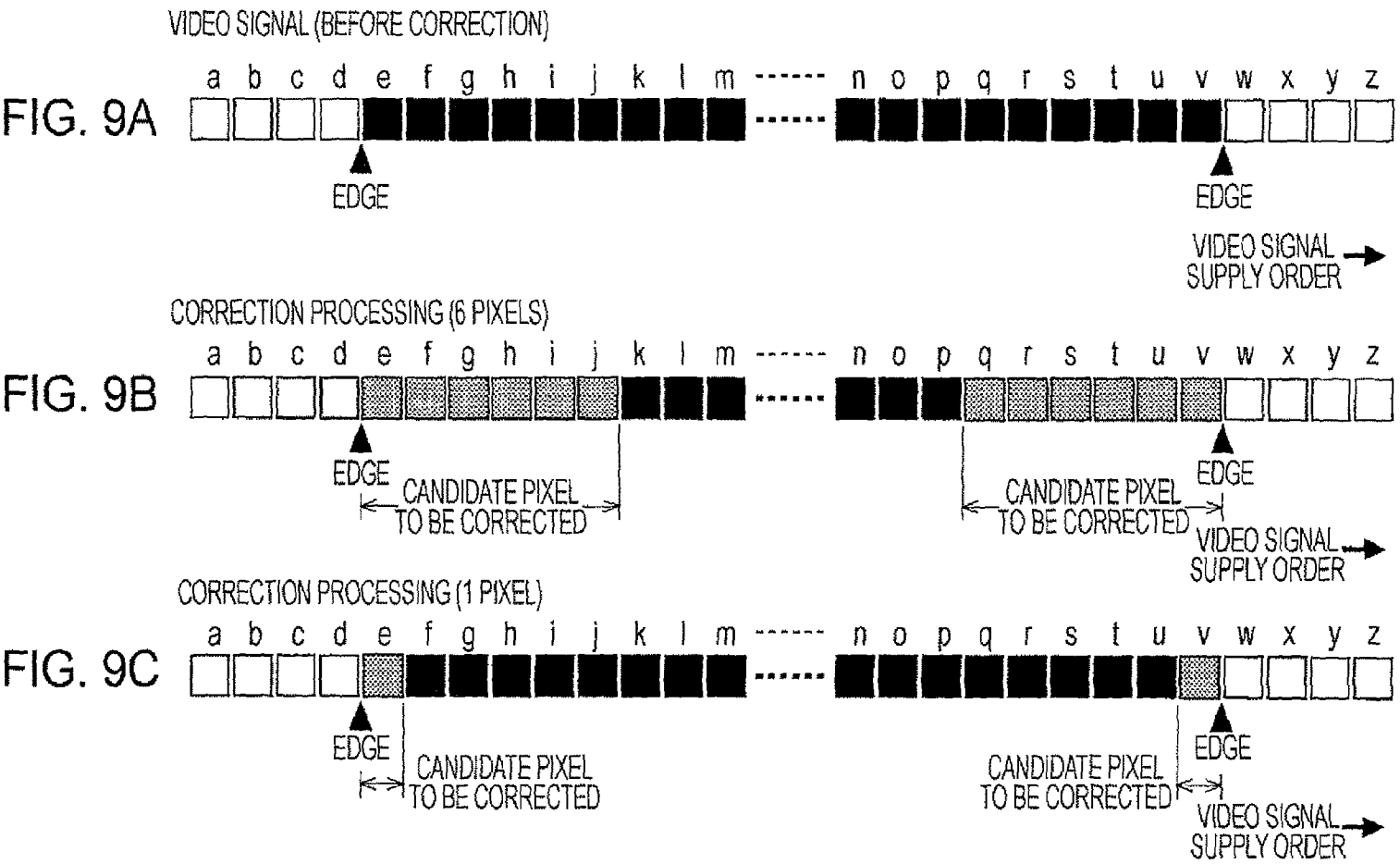
FIGS. 9A, 9B and 9C are diagrams each illustrating the content of processing performed by a video processing circuit according to a second embodiment of invention.

Next, operations of a video processing circuit according to the second embodiment will be described below with reference to FIGS. 9 to 11. Here, it is assumed that, in an image specified by the video signal Vid-in, the content of display data on a certain line is such as shown in FIG. 9A, and, more specifically, is such that rows from "a" to "d" specify white pixels, rows from "e" to "v" specify black rows, and rows from "w" to "z" specify white pixels. In addition, it is assumed that rows continuously aligned at the left side of the row "a" specify white pixels, rows aligned between the row "m" and the row "n" specify black pixels, and rows continuously aligned at the right side of the row "z" specify black pixels, these rows being omitted from illustration.

In such an image, edges are detected at two portions, one being a portion between the row "d" and the row "e", the other one being a portion between the row "v" and the row "w". Therefore, from a viewpoint of a temporal feeding order, candidate pixels to be corrected are pixels aligned subsequent to the edge between the row "d" and the row "e" (i.e., pixels aligned at the right side of the edge from a viewpoint of a spatial alignment), and pixels aligned prior to the edge between the row "v" and the row "w" (i.e., pixels aligned at the left side of the edge from a viewpoint of a spatial alignment).

Further, in this example, it is supposed that, as shown in FIG. 9B, the number of candidate pixels to be corrected, which are continuously aligned from the edge position, is "6".

Figure 10:
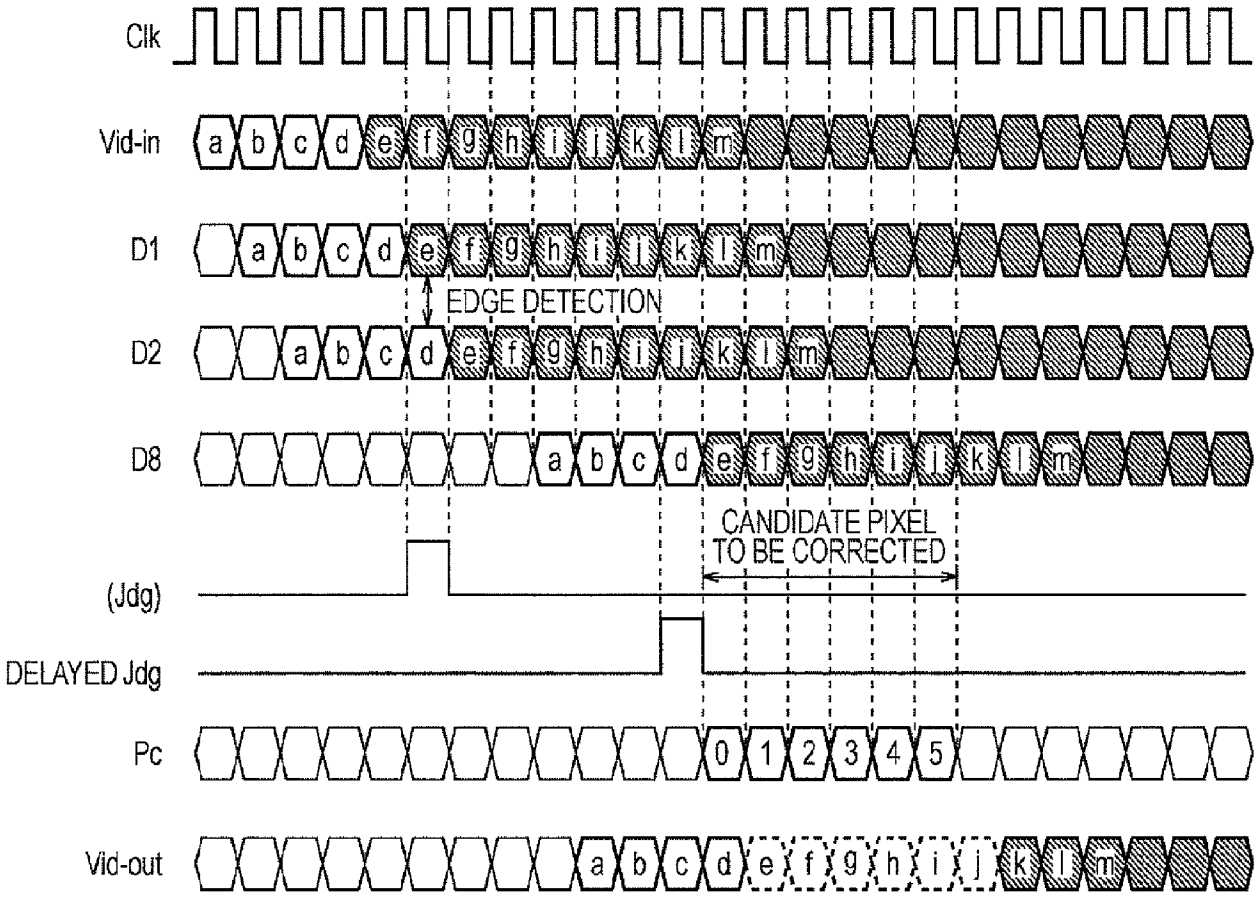
FIG. 10 is a diagram illustrating correction operations performed by a video processing circuit according to a second embodiment of the invention.
Figure 11:
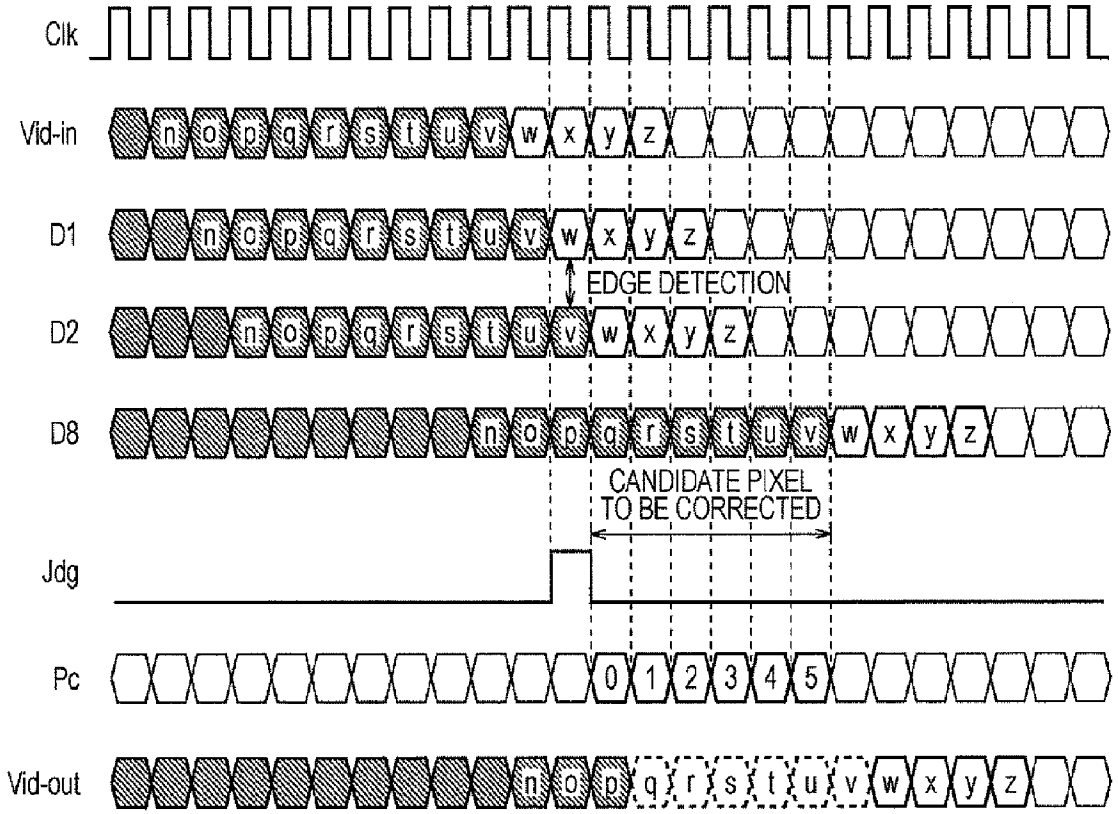
FIG. 11 is a diagram illustrating correction operations performed by a video processing circuit according to a second embodiment of the invention.

FIG. 10 is a diagram illustrating operations performed in the case where pixels subsequent to an edge are candidates to be corrected, and FIG. 11 is a diagram illustrating operations performed in the case where pixels prior to an edge are candidates to be corrected.

Firstly, operations performed in the case where pixels subsequent to an edge are candidates to be corrected will be described below with reference to FIG. 10.

The video signal Vid-in is supplied in accordance with the dot clock signal C1k in such an order as a row "a", a row "b", a row "c", . . . .

The video signal D1 is delayed by one cycle of the dot clock signal C1k (i.e., by a period of time equivalent to one pixel) by the delay circuit 308 relative to the video signal Vid-in, and the video signal D2 is further delayed by a period of time equivalent to one pixel by the delay circuit 309 relative to the video signal D1.

In the video signals D1 and D2, which have been delayed as described above, since the row "e" of the video signal D1 is within the gray scale range "a", and the row "d" of video signal D2 is within the gray scale range "b", the discrimination unit 310 discriminates that a portion between the row "b" and the row "d" is an edge in the first case. Therefore, the discrimination signal Jdg rises to H level at a timing when the timing of the discrimination of the edge has been delayed by six pixels, that is, at a timing when a pixel, which is specified by the video signal D8, becomes the row "d" pixel, which is contacted with the edge so as to be prior thereto. The counter 311 increments the count value Pc thereof from "0" to "5" during a period of time equivalent to six pixels, which are candidate pixels to be corrected, immediately after the discrimination signal Jdg has fallen to L-level.

Therefore, the correction unit 315 handles six pixels from the row "e" following the row "d" to the row "j" as candidates for correction. If, among the six pixels from the row "e" to the row "j", there are any pixels, each of which has a gray scale lower that the gray level "c", the gray scales of the pixels are replaced by the gray scale "c", and if each of the six pixels has a gray scale higher than or equal to the gray scale "c", any gray scales specified by the video signal D8 are not replaced.

In addition, taking into consideration processing time for replacement, the video signal Vid-out, which is outputted from the correction unit 315, is delayed by a period of time equivalent to one pixel, and then, is outputted.

Next, operations performed in the case where pixels prior to an edge are candidates for correction will be described below with reference to FIG. 11.

The video signal Vid-in is supplied in such an order as a row "x", a row "y", a row "z", . . . in accordance with the dot clock signal C1k.

The video signal D1 is delayed by a period of time equivalent to one pixel relative to the video signal Vid-in, and the video signal D2 is further delayed by a period of time equivalent to one pixel by the delay circuit 309 relative to the video signal D1.

In the video signals D1 and D2, which have been delayed as described above, since the row "w" of the video signal D1 is within the gray scale range "b", and the row "v" of the video signal D2 is within the gray scale range "a", the discrimination unit 310 discriminates that a portion between the row "w" and the row "b" is an edge in the second case. Therefore, the discrimination signal Jdg rises to H level at a timing when the edge has been discriminated, that is, at a timing when a pixel specified by the video signal D8 becomes a row "p", which is seven pixels prior to the edge in the second case.

The counter 311 increments the count value Pc thereof from "0" to "5" during a period of time equivalent to six pixels, which are candidate pixels to be corrected, immediately after the discrimination signal Jdg has fallen to L-level, and therefore, the correction unit 315 handles six pixels from the row "q" following the row "p" to the row "v" as candidates for correction, among pixels specified by the video signal D8. If, among the six pixels from the row "q" to the row "v", having been candidates for correction, there are any pixels, each of which has a gray scale lower that the gray level "c", the gray scales of the pixels are replaced by the gray scale "c", and if each of the six pixels has a gray scale higher than or equal to the gray scale "c", any gray scales specified by the video signal D8 are not replaced.

In such a configuration adopted in the first embodiment, in which, portions, at which dark pixels and bright pixels are located adjacent to each other in a horizontal direction or in a vertical direction, are detected as edges, any two pixels adjacent to each other for the same line and any two pixels adjacent to each other for the same row are compared, and thus, particularly, the circuit size of the edge detection unit 302 is likely to be large. Further, an amount of delay of the delay circuit 312 is necessary for an amount equivalent to the number of a plurality of lines.

In contrast, In such a configuration adopted in the second embodiment, in which, portions, at which dark pixels and bright pixels are located adjacent to each other in a horizontal direction, are detected as edges, merely comparing any two pixels adjacent to each other for the same line is necessary, further, in this example, merely an amount of delay equivalent to eight pixels is necessary, and thus, it is possible to reduce the circuit size.

Example of Application/Modification of Second Embodiment

In the above-described embodiment, the number of candidate pixels for correction is "6", however, it is not limited thereto, but, for example, it may be "1", such as shown in FIG. 9C. In the case where the number of candidate pixels is "1", for example, in the correction unit 315, the effective value of the count value Pc is made be only "0", and the discrimination unit 310 is configured to, upon discrimination of an edge of the second case, cause the discrimination signal Jdg to rise to H-level with a delay by five cycles of the dot clock signal subsequent to discrimination of the edge.

Figure 12:
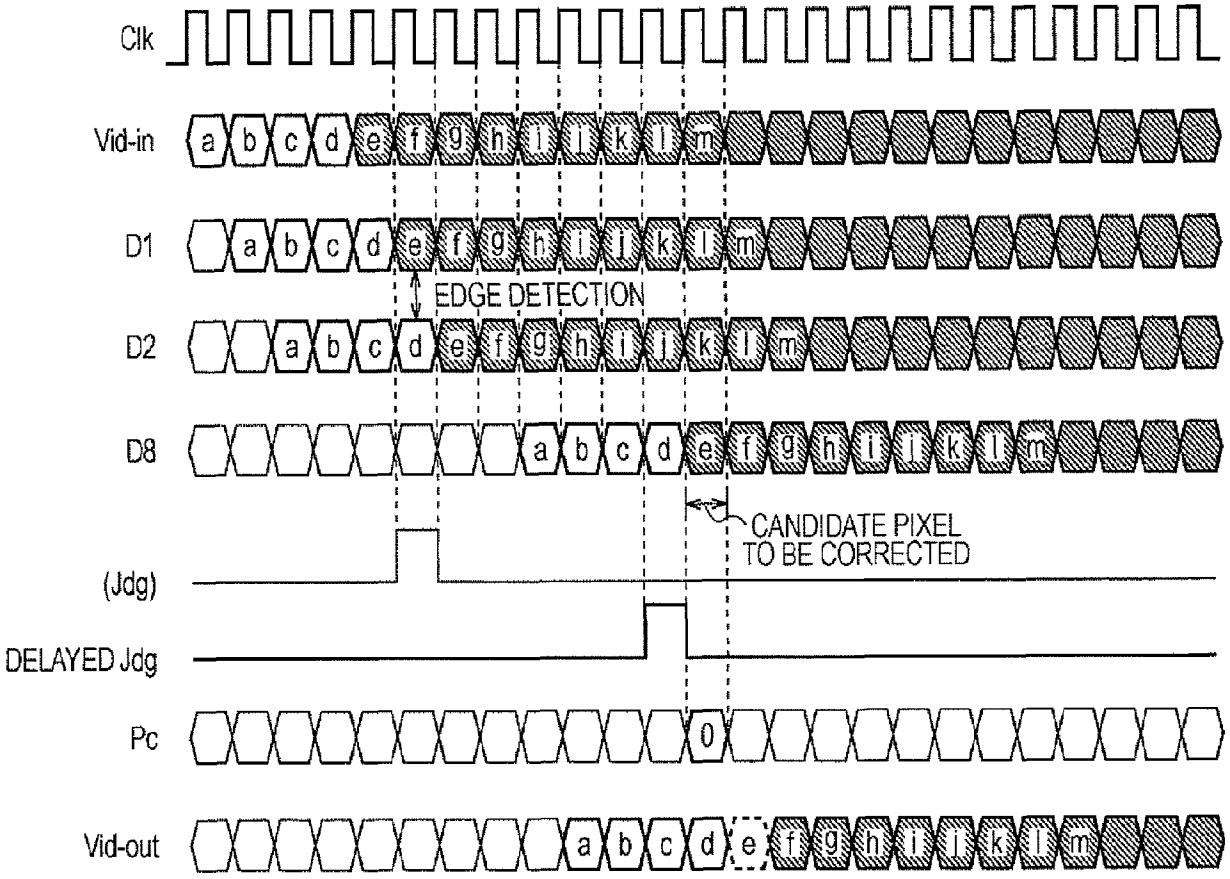
FIG. 12 is a diagram illustrating correction operations performed by a video processing circuit according to a second embodiment of the invention.

In such a configuration as described above, in the case where pixels subsequent to the edge are candidates for correction, as shown in FIG. 12, since the discrimination signal Jdg rises to H-level at a timing when the video signal D8 becomes a row "d", the count value Pc becomes "0" at a timing when the video signal becomes a row "e", which is contacted with the edge so as to be subsequent thereto. Therefore, in the correction unit 315, among rows included in the video signal D8, only a pixel located at the row "e" subsequent to the row "d" becomes a candidate for correction.

Figure 13:
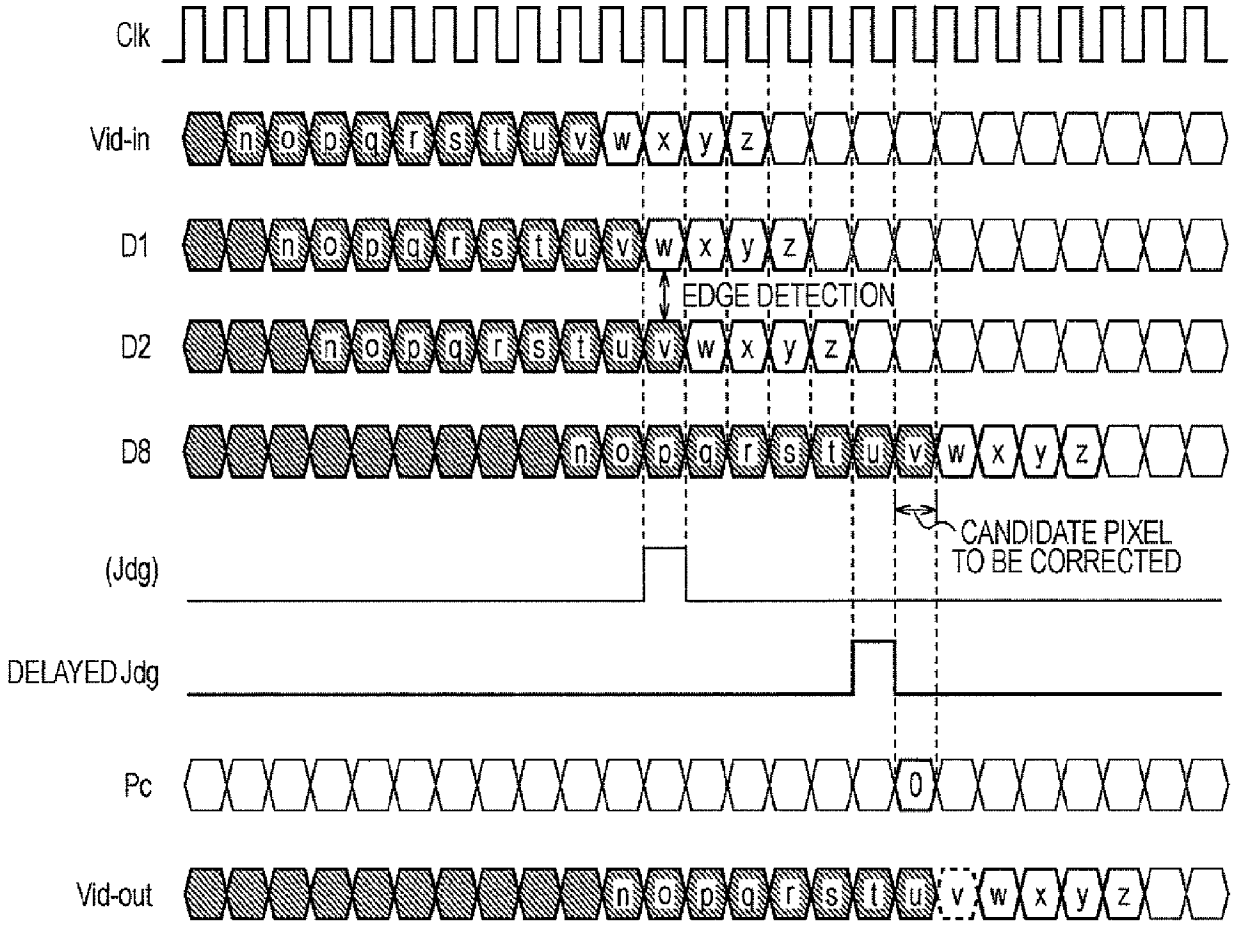
FIG. 13 is a diagram illustrating correction operations performed by a video processing circuit according to a second embodiment of the invention.

In contrast, in the case where pixels prior to the edge are candidates for correction, as shown in FIG. 13, since the discrimination signal Jdg rises to H-level at a timing when the video signal D8 becomes a row "u", the count value Pc becomes "0" at a timing when the video signal D8 becomes a row "v", which is contacted with the edge so as to be prior thereto. Therefore, in the correction unit 315, among rows included in the video signal D8, only a pixel located at the row "v" subsequent to the row "u" becomes a candidate for correction.

In addition, if the gray scale of the row "e" (the row "v") having become a candidate for correction, the gray scale of the row "e" (the row "v") being specified by the video signal D8, is lower than the gray scale "c", the gray scale of the row "e" (the row "v") is replaced by the gray scale "c", and if the gray scale of the row "e" (the row "v") is higher than or equal to the gray scale "c", the gray scale of the row "e" (the row "v") is not replaced.

The number of candidate pixels for correction can be appropriately set to one of numbers other than "1" or "6".

In each of the above-described embodiments, the video signal Vid-in specifies gray scales according to respective pixels, but may directly specify the levels of applied voltages corresponding to respective pixels. In the case where the video signal Vid-in specifies the levels of applied voltages corresponding to respective pixels, a configuration, in which edges are discriminated on the basis of the levels of specified voltages, and the levels of specified voltages are corrected, may be adopted.

In each of the above-described embodiments, the liquid crystal element 120 is not limited to a transmission-type one, but may be a reflection-type one.

Figure 4B:
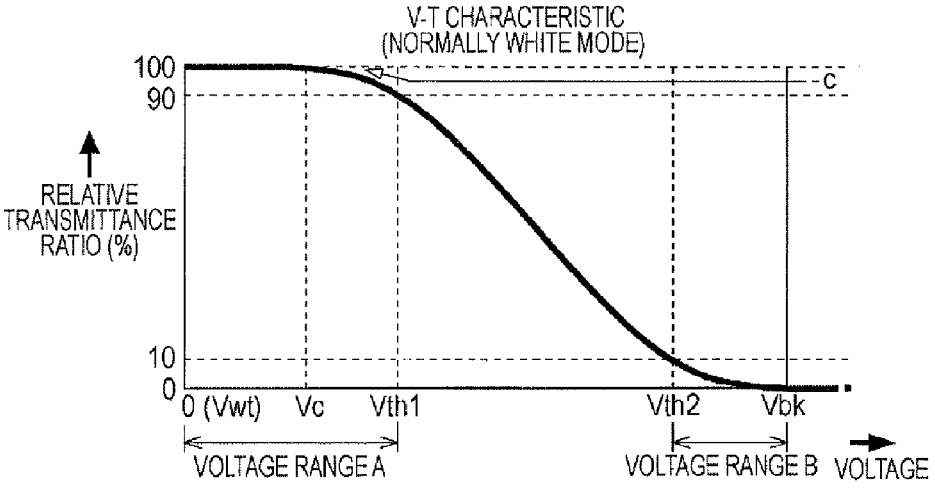

Further, the liquid crystal element 120 may be in a mode that is not limited to the normally black mode but is the normally white mode, which can be realized in, for example, the TN method. Further, in the normally mode, the liquid crystal elements 120 are in a white-color condition when no voltage is applied thereto, the normally white mode being able to be realized by adopting. Further, in the normally white mode, a relation between an applied voltage and a transmisstance ratio regarding the liquid crystal element 120 is represented by a V-T characteristic, such as shown in FIG. 4B, and in the V-T characteristic, the transmisstance ratio reduces along with increasing of the applied voltage. In this case, there is no change in the phenomenon, in which pixels affected by lateral-direction electric fields are pixels having lower applied voltages therefor, and thus, the method, in which the levels of applied voltages for pixels, which are lower than the level of the voltage Vc, are replaced by the level of the voltage Vc, is the same.

Figure 14:
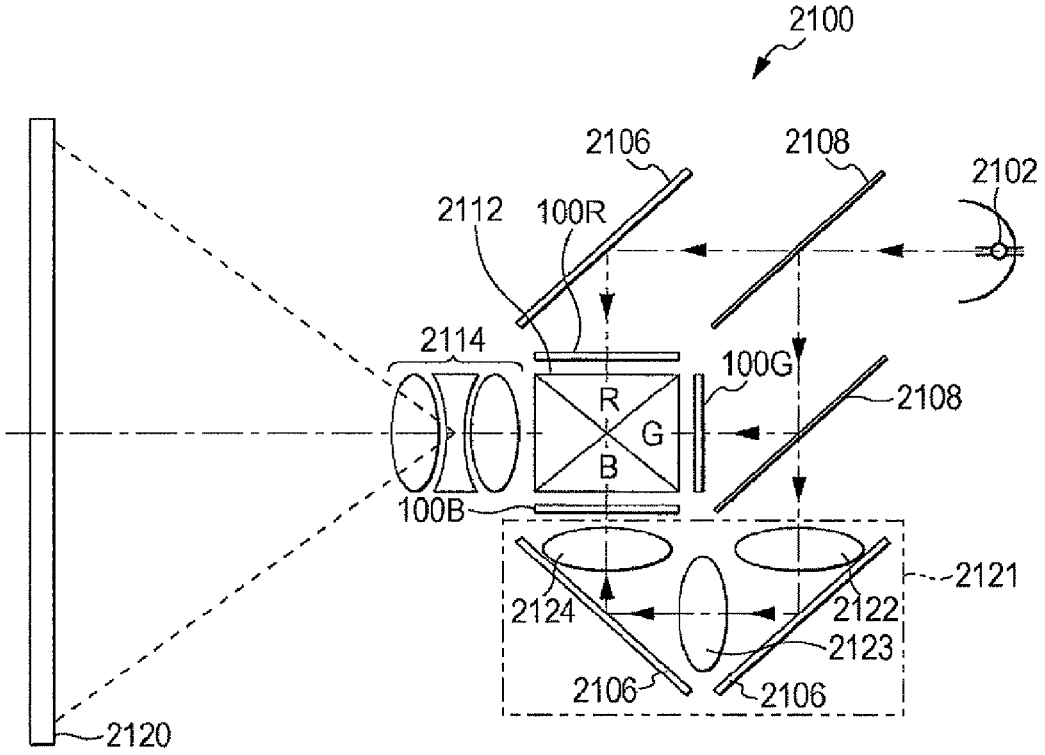
FIG. 14 is a diagram illustrating a projector, to which a liquid crystal display apparatus according to an embodiment of the invention is applied.

Next, as an example of an electronics device using a liquid crystal display apparatus according to the above-described embodiments, a projection-type display apparatus (a projector) using the liquid crystal panel 100 as a light valve will be described hereinafter. FIG. 14 is a plan view illustrating a configuration of such a projector.

As shown in FIG. 14, a lamp unit 2102 including a white light source, such as a halogen lamp, is provided inside the projector 2100. A projecting light projected from the lamp unit 2102 is separated into light rays of three primary colors i.e., R (red), G (green) and B (blue) by three mirrors 2106 and two dichroic mirrors 2108, and is conducted to light valves 100R, 100G and 100B, which correspond to the three primary colors, respectively. In addition, the light ray of B color has a light path longer than each of the other light rays, i.e., the light ray of R color or the light ray of G color, and therefore, in order to prevent a loss thereof, is conducted via a relay Lens system 2121 including an incident lens 2121, a relay lens 2123 and an outgoing lens 2124.

In such the projector 2100, three liquid crystal display apparatuses, each including the liquid crystal panel 100, are provided so as to correspond to the R color, the G color and the B color, respectively, are provided. The configuration of each of the light valves 100R, 100G and 100B is the same as or similar to that of the above-described liquid panel 100. The projector 2100 is configured so that, once respective gray scale levels of the primitive color components, i.e., the R color component, the G color component and the B color component, are specified, video signals are supplied from respective external upper circuits, and the light valve 100R, the light valve 100G and the light valve 100B are driven, respectively. Light rays having been modulated by the light valve 100R, the light valve 100G and the light valve 100B enter a dichroic prism 2112 from three directions. Further, in this dichroic prism 2112, the light ray of the R color, as well as the light ray of the B color, is refracted in a direction orthogonal to an incident direction thereof, while the light ray of the G color goes straight.

Therefore, as a result, after combination of images, each being an image of one of the three primitive colors, color images are projected on a display screen 2120 by a group of projection lenses 2114.

In addition, since light rays corresponding to the R color, the G color, and the B color are entered the light valve 100R, the light valve 100G and the light valve 100B by the dichroic mirror 2108, it is unnecessary to attach color filters to the light valve 100R, the light valve 100G and the light valve 100B, respectively. Further, images transmitted through the light valve 100R and the light valve 100B are projected after having been reflected by the dichroic prism 2112, while images through the light valve 100G are projected as they are, and therefore, the projector 2100 is configured to cause the directions of horizontal scanning performed by the light valves 100R and 100B to be opposite the direction of horizontal scanning performed by the light valve 100G, and then, display mirror reversed images.

With respect to electronics devices, besides the projector having been described with reference to FIG. 14, television sets, view-finder-type/monitor-direct-view-type videotape recorders, car navigation apparatuses, pagers, electronic organizers, electronic calculators, word processers, work-stations, TV telephones, POS terminals, digital still cameras, mobile telephone terminals, devices with touch panels and the like can be provided. Further, it goes without saying that, to these various kinds of electronics devices, the above-described liquid crystal display apparatus can be applied.

What is claimed is:

1. A signal processing device, for use with a liquid crystal device including a plurality of pixels, the signal processing device comprising a signal processing unit that processes a signal that controls a gray scale level that is displayed at each of the plurality of pixels for each frame, wherein:

with respect to a first pixel that displays a first gray scale level lower than a first reference gray scale level, and which is adjacent to a pixel that displays a gray scale level higher than a second reference gray scale level, the signal processing unit corrects so as to display a gray scale level that is higher than or equal to the first reference gray scale level and lower than the second reference gray scale level, and the correction is performed by the signal processing device based upon detection of the first gray scale level and the first pixel.

2. A signal processing device, for use with a liquid crystal device including a plurality of pixels, the signal processing device comprising a signal processing unit that processes a signal that controls a voltage to be applied to each of the plurality of pixels for each frame, wherein:

with respect to a first pixel to which a first voltage is applied that is lower than a first reference voltage, and which is adjacent to a pixel to which a voltage is applied that is higher than a second reference voltage, the signal processing device unit so as to apply a voltage that is higher than or equal to the first reference voltage and lower than the second reference voltage, and the correction is performed by the signal processing device based upon detection of the first voltage and the first pixel.

3. A signal processing device, for use with a liquid crystal device including a plurality of pixels, the signal processing device comprising:

a signal processing unit that processes a signal that controls a gray scale level that is displayed at each of the plurality of pixels for each frame;

an edge detection unit configured to detect a first pixel that displays a gray scale level lower than a third reference gray scale level, and which is adjacent, in a first direction, to a pixel that displays a gray scale level higher than a fourth reference gray scale level and a second pixel that is adjacent to the first pixel in the first direction, wherein if the first or second pixel displays a gray scale level lower than a fifth reference gray scale level that is lower than the third reference gray scale level, the signal processing device corrects the first or second pixel so as to display a gray scale level higher than or equal to the fifth reference gray scale level and lower than the third reference gray scale level.

4. A signal processing device, for use with a liquid crystal device including a plurality of pixels, the signal processing device comprising:

a signal processing unit that processes a signal that controls a voltage to be applied to each of the plurality of pixels for each frame;

an edge detection unit configured to detect a first pixel to which a voltage is applied that is lower than a third reference voltage, and which is adjacent, in a first direction, to a pixel to which a voltage is applied that is higher than a fourth reference voltage, and a second pixel that is adjacent to the first pixel in the first direction, wherein if the voltage that is applied to the first or second pixel is a voltage lower than a fifth reference voltage that is lower than the third reference voltage, the signal processing device corrects so as to apply, to the first or second pixel, a voltage that is higher than or equal to the fifth reference voltage and lower than the third reference voltage.

5. A liquid crystal display device comprising the signal processing device of claim 1.

6. A liquid crystal display device comprising the signal processing device of claim 2.

7. A liquid crystal display device comprising the signal processing device of claim 3.

8. A liquid crystal display device comprising the signal processing device of claim 4.

9. An electronic device comprising the liquid crystal display device of claim 5.

10. An electronic device comprising the liquid crystal display device of claim 6.

11. An electronic device comprising the liquid crystal display device of claim 7.

12. An electronic device comprising the liquid crystal display device of claim 8.

13. A signal processing method, for use with a liquid crystal device including a plurality of pixels, comprising processing a signal that controls a gray scale level that is displayed at each of the plurality of pixels for each frame, wherein:

with respect to a first pixel that displays a first gray scale level lower than a first reference gray scale level, and which is adjacent to a pixel that displays a gray scale level higher than a second reference gray scale level, the method further comprises correcting so as to display a gray scale level that is higher than or equal to the first reference gray scale level and lower than the second reference gray scale level, the correcting being based upon detection of the first gray scale level and the first pixel.

14. A signal processing method, for use with a liquid crystal device including a plurality of pixels, comprising processing a signal that controls a voltage to be applied to each of the plurality of pixels for each frame, wherein:

with respect to a pixel to which a first voltage is applied that is lower than a first reference voltage, and which is adjacent to a pixel to which a voltage is applied that is higher than a second reference voltage, method further comprises correcting so as to apply a voltage that is higher than or equal to the first reference voltage and lower than the second reference voltage, the correcting being based upon detection of the first voltage and the first pixel.

15. A signal processing method, for use with a liquid crystal device including a plurality of pixels, comprising processing a signal that controls a gray scale level that is displayed at each of the plurality of pixels for each frame, wherein:

with respect to (i) a first pixel that displays a gray scale level lower than a third reference gray scale level, and which is adjacent, in a first direction, to a pixel that displays a gray scale level higher than a fourth reference gray scale level and (ii) a second pixel that is adjacent to the first pixel in the first direction, if the first or second pixel displays a gray scale level lower than a fifth reference gray scale level that is lower than the third reference gray scale level, the method further comprises correcting such that the first or second pixel displays a gray scale level higher than or equal to the fifth reference gray scale level and lower than the third reference gray scale level, the correcting being based upon detection of the first pixel and the second pixel.

16. A signal processing method, for use with a liquid crystal device including a plurality of pixels, comprising processing a signal that controls a voltage to be applied to each of the plurality of pixels for each frame, wherein:

with respect to (i) a first pixel to which a first voltage is applied that is lower than a third reference voltage, and which is adjacent, in a first direction, to a pixel to which a voltage is applied that is higher than a fourth reference voltage, (ii) a second pixel that is adjacent to the first pixel in the first direction, if a voltage that is applied to the first or second pixel is lower than a fifth reference voltage that is lower than the third reference voltage, the method further comprises correcting so as to apply, to the first or second pixel, a voltage that is higher than or equal to the fifth reference voltage and lower than the third reference voltage, the correcting being based upon detection of the first pixel and the second pixel.

* * * * *